US009205665B2

(12) United States Patent
Kaneko

(10) Patent No.: US 9,205,665 B2
(45) Date of Patent: Dec. 8, 2015

(54) INKJET APPARATUS USING PIEZOELECTRIC PUMP

(71) Applicant: TOSHIBA TEC KABUSHIKI KAISHA, Tokyo (JP)

(72) Inventor: Yoshiaki Kaneko, Mishima Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/573,333

(22) Filed: Dec. 17, 2014

(65) Prior Publication Data

US 2015/0174910 A1 Jun. 25, 2015

(30) Foreign Application Priority Data

Dec. 19, 2013 (JP) ..... 2013-262019

(51) Int. Cl.

| | |
|---|---|
| ***F04B 17/00*** | (2006.01) |
| ***B41J 2/18*** | (2006.01) |
| ***B41J 2/175*** | (2006.01) |
| ***F04B 43/04*** | (2006.01) |
| ***F04B 49/22*** | (2006.01) |

(52) U.S. Cl.

CPC ..... *B41J 2/17596* (2013.01); *F04B 43/046* (2013.01); *F04B 49/225* (2013.01)

(58) Field of Classification Search

USPC ..... 347/54, 68, 70, 84, 89, 90; 417/3, 77, 417/413.1, 413.2, 395, 559

See application file for complete search history.

(56) References Cited

U.S. PATENT DOCUMENTS

| | | | | |
|---|---|---|---|---|
| 4,462,037 | A * | 7/1984 | Bangs et al. | 347/85 |
| 6,231,174 | B1 * | 5/2001 | Haigo | 347/89 |
| 7,196,457 | B2 * | 3/2007 | Miyazawa et al. | 310/358 |
| 2003/0002995 | A1 * | 1/2003 | Urano et al. | 417/322 |
| 2008/0101965 | A1 * | 5/2008 | Zhang | 417/413.2 |
| 2008/0260552 | A1 * | 10/2008 | Ma et al. | 417/395 |

FOREIGN PATENT DOCUMENTS

| | | | | |
|---|---|---|---|---|
| JP | 04051964 | * | 2/1992 | A61M 5/142 |
| JP | 2001193656 | A | 7/2001 | |
| JP | 2005-125670 | A | 5/2005 | |

* cited by examiner

*Primary Examiner* — Anh T. N. Vo

(74) *Attorney, Agent, or Firm* — Patterson & Sheridan, LLP

(57) ABSTRACT

A piezoelectric pump includes a housing, a first valve member, and a second valve member. The housing includes an inlet, a first chamber, a second chamber having a wall made of piezoelectric material, a third chamber, and an outlet connected in this order. The first valve member is disposed entirely within the first chamber and movable between a first position at which the first valve member is disposed entirely within the first chamber and fluid in the inlet flows into the first chamber, and a second position at which the first valve member is disposed entirely within the first chamber and the fluid in the inlet is prevented from flowing into the first chamber. The second valve member is disposed similarly to the first valve member.

16 Claims, 12 Drawing Sheets

INKJET APPARATUS USING PIEZOELECTRIC PUMP

CROSS-REFERENCE TO RELATED APPLICATION

This application is based upon and claims the benefit of priority from Japanese Patent Application No. 2013-262019, filed Dec. 19, 2013, the entire contents of which are incorporated herein by reference.

FIELD

Embodiments described herein relate generally to a piezoelectric pump for conveying a fluid and an ink jet apparatus having the same.

BACKGROUND

One type of an inkjet apparatus circulates ink through an ink jet head and ejects the ink through a nozzle. As the ink does not stay in the vicinity of the nozzle for a long period of time, the condition of the ink can be maintained, and as a result ink of the desired condition can be discharged.

Such an ink jet apparatus includes an ink tank and a pump for circulating the ink, and according to the operation of the pump, the ink is supplied from the ink tank to the ink jet head and recovered from the ink jet head to the ink tank.

However, the mechanism to circulate the ink through the ink jet head, including the pump, needs a lot of space, and so the ink jet apparatus having such a mechanism according to the related art may be too large. Further, as the pump according to the related art employs a valve member fixed to a housing and the ink flows through a small opening in the valve member, a flow rate of the ink through the pump according to the related art may be insufficient to circulate the ink.

DETAILED DESCRIPTION

In an ink jet apparatus according to the related art, a circulation mechanism including an ink tank that stores the ink, a pump to convey the ink, and pipes for circulating the ink is needed.

As the circulation mechanism needs significant space, the size of the ink jet apparatus including such a circulation mechanism likely to be large. When the ink jet head and the circulation mechanism are integrated into a single unit, the size of the ink jet apparatus may be reduced. In order to integrate the ink circulation mechanism with the ink jet head, a pump that has a large ink conveying capacity is preferred. A pump according to the related art may not have sufficient ink conveying capacity for the integrated unit.

In general, according to one embodiment, a piezoelectric pump includes a housing including an inlet, a first chamber connected to the inlet, a second chamber enclosed by a wall made of piezoelectric material and connected to the first chamber, a third chamber connected to the second chamber, and an outlet connected to the third chamber, a first valve member disposed entirely within the first chamber and movable between a first position at which the first valve member is disposed entirely within the first chamber and fluid in the inlet flows into the first chamber, and a second position at which the first valve member is disposed entirely within the first chamber and the fluid in the inlet is prevented from flowing into the first chamber, and a second valve member disposed entirely within the third chamber and movable between a third position at which the second valve member is disposed entirely within the third chamber and fluid in the second chamber flows into the third chamber through the outlet, and a fourth position at which the second valve member is disposed entirely within the third chamber and the fluid in the second chamber is prevented from flowing into the third chamber through the outlet.

Hereinafter, an embodiment will be described with reference to the drawings.

Figure 1:
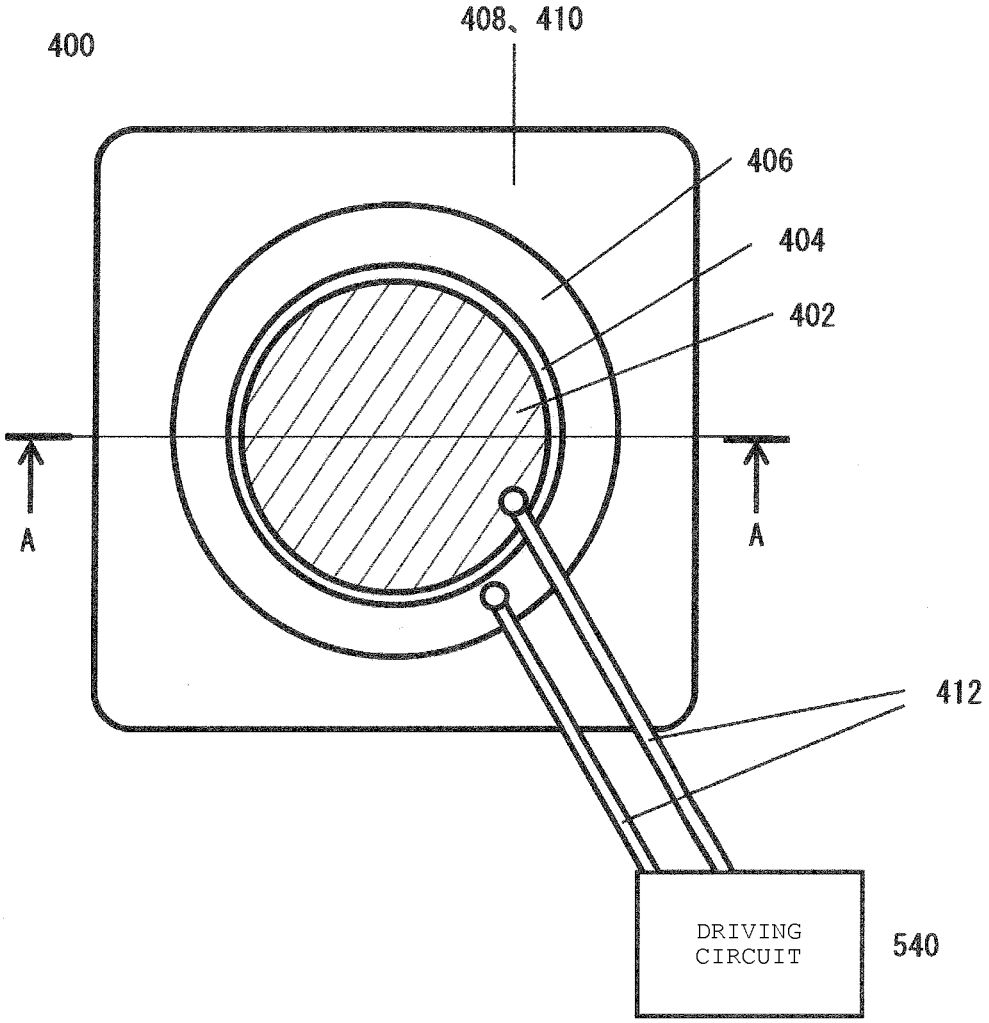
FIG. 1 is a schematic view of a piezoelectric pump according to an embodiment.
Figure 2A:
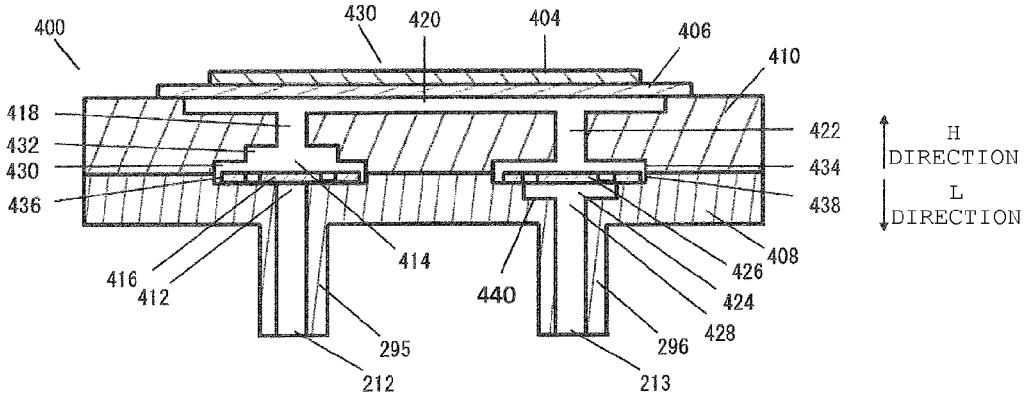
FIGS. 2A and 2B are cross-sectional views of the piezoelectric pump according to the embodiment.
Figure 2B:
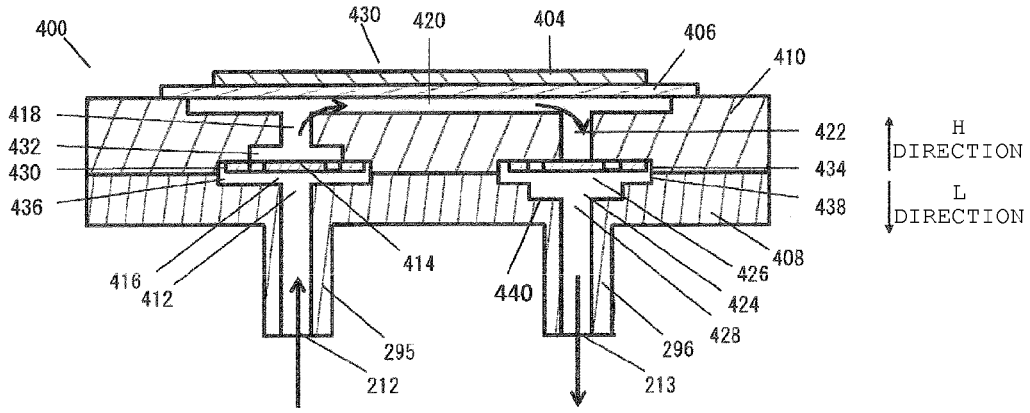
Figure 3:
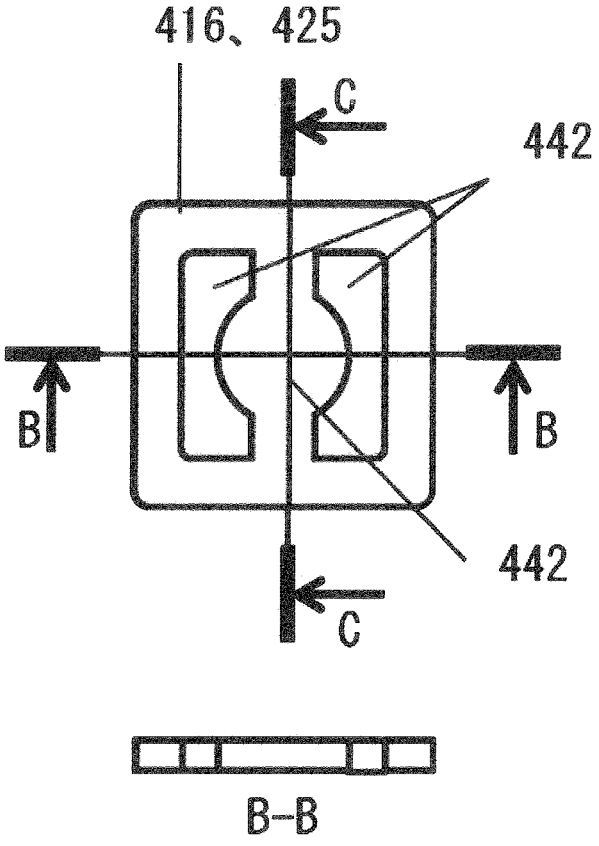
FIG. 3 is a plan view of a check valve member of the piezoelectric pump according to the embodiment.

FIG. 1 illustrates an external view of a piezoelectric pump according to an embodiment, which is connected to a driving source. FIGS. 2A and 2B illustrate cross-sectional view of the piezoelectric pump taken along the line A-A. FIG. 3 illustrates structure of a check valve member provided in a liquid chamber of the piezoelectric pump.

A liquid suction section of a piezoelectric pump 400 includes an inlet port 412 into which a liquid flows, a suction chamber 414 (first liquid chamber) which can be connected to the inlet port 412, and a first communication hole 418 which is connected to the suction chamber 414. The first communication hole 418 is connected to a pump chamber 420 of the piezoelectric pump 400, and the piezoelectric pump 400 feeds the liquid by increasing or decreasing the volume of the pump chamber 420. When the volume of the pump chamber 420 is increased, the liquid is suctioned from the inlet port 412 through the first liquid chamber 414. When the volume of the pump chamber 420 is decreased, the liquid is fed to a liquid feed chamber 424 (second liquid chamber) from the pump chamber 420 through a second communication hole 422. The liquid is transported to the outside of the piezoelectric pump 400 from the liquid feed chamber 424 through a liquid feed port 428. The suction chamber 414 and the liquid feed chamber 424 each include a check valve member so that the liquid is suctioned from the inlet port 412 and is transported from the liquid feed port 428 to flow in one direction. Hereinafter, the configuration will be described in detail.

The piezoelectric pump 400 includes a lower housing 408, an upper housing 410 which is assembled with the lower housing 408 to form the suction chamber 414 and the liquid feed chamber 424, and a piezoelectric actuator 430 fixed onto the upper housing 410. The piezoelectric actuator 430 includes a metal plate 406, a piezoelectric ceramic 404 fixed onto the metal plate 406, and a silver paste 402 which is applied onto the piezoelectric ceramic 404 to act as an electrode 402. The metal plate 406 is made of stainless steel and has a diameter of 30 mm and a thickness of 0.2 mm. A surface of the metal plate 406 on the pump chamber 420 side is formed with a resin coating film. The coating surface is provided to prevent the metal plate 406 from being in contact with the liquid in the pump chamber 420. The piezoelectric ceramic 404 is made of lead zirconate titanate (PZT) and has a diameter of 25 mm and a thickness of 0.4 mm. The piezoelectric ceramic 404 is polarized in the thickness direction so that, when an electric field is applied thereto in the thickness direction, the piezoelectric ceramic 404 is extended or contracted in the surface direction to expand or contract the pump chamber 420. The electrode 402 on the piezoelectric ceramic 404 and the metal plate 406 are connected to a driving circuit 540 through a wire 412. The driving circuit 540 operates the piezoelectric actuator 430 with an AC voltage of a frequency of 100 Hz and a voltage of 100 V. The piezoelectric actuator 430 transports the liquid by expanding or contracting the volume of the pump chamber 420.

For the material of the metal plate 406, instead of the stainless steel, nickel, brass, gold, silver, copper, or the like may be used. As the piezoelectric ceramic 404, instead of PZT, PTO ($PbTiO_3$ (lead titanate)), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, AlN, or the like may be used. The piezoelectric actuator 430 is operable with an AC voltage, as an operating voltage, in a range of 1 mV to 200 V and at a frequency in a range of 1 mHz to 200 Hz. The driving voltage and the driving frequency are determined according to the viscosity of the liquid and the amount of transported liquid.

The upper housing 410 is made of a polyphenylene sulfide (PPS) resin having a diameter of 40 mm and a thickness of 3 mm and has a recessed portion having a diameter of 30 mm and a depth of 0.1 mm in the upper portion thereof. The metal plate 406 of the piezoelectric actuator 430 is fixed to the upper housing 410 with an adhesive to cover the recessed portion, thereby forming the pump chamber 420. The lower portion of the upper housing 410 includes a first recessed portion 430 having a depth of 0.1 mm in a square shape having a side length of 9.2 mm and a second recessed portion 432 having a depth of 0.2 mm in a square shape having a side length of 7.5 mm, and having the same center as the first recessed portion 430, so that the suction chamber 414 is formed. The first communication hole 418 has a diameter of 2 mm penetrates through the upper housing 410 and the same center as the second recessed portion 432, and is connected to the pump chamber 420. Moreover, in the lower portion of the upper housing 410, a third recessed portion 434 having a depth of 0.1 mm in a square shape and a side length of 9.2 mm is formed so as to form the liquid feed chamber 424. The second communication hole 422 having a diameter of 2 mm penetrates through the upper housing 410, has the same center as the third recessed portion 434, and is connected to the pump chamber 420.

The lower housing 408 is made of a PPS resin and has a diameter of 40 mm and a thickness of 3 mm. The lower housing 408 includes a fourth recessed portion 436 having a depth of 0.1 mm in a square shape, a side length of 9.2 mm, and the same center as the first recessed portion 430 so as to form the suction chamber 414. When the lower housing 408 and the upper housing 410 are adhered to each other, the suction chamber 414 having a side length of 9.2 mm and a height of 0.2 mm is formed with the first recessed portion 430 and the fourth recessed portion 436. In the fourth recessed portion 436, a first liquid communication passage 295 having a diameter of 2 mm and the same center as the first communication hole 418 is provided to suction the liquid from the outside of the piezoelectric pump 400. The liquid is suctioned into the suction chamber 414 through the first liquid communication passage 295. Furthermore, in the lower housing 408, a fifth recessed portion 438 having a depth of 0.1 mm in a square shape and a side length of 9.2 mm is formed so as to form the liquid feed chamber 424. A sixth recessed portion 440 having a depth of 0.2 mm in a square shape and a side length of 7.5 mm and a second liquid communication passage 296 are provided so as to have the same center as the fifth recessed portion 438.

The suction chamber 414 and the liquid feed chamber 424 are angular liquid chambers. Instead of the angular shapes, cylindrical liquid chambers may also be employed therefor.

A first check valve member 416 is provided in the suction chamber 414. The first check valve member 416 is made of polyimide and has an angular shape with a thickness of 0.03 mm and a peripheral frame portion having a width of 9 mm. Polyimide having a Young's modulus of $4\times10^9$ Pa is used for the first check valve member 416. As illustrated in FIG. 3, the first check valve member 416 is axially symmetric with respect to the line C-C. The first check valve member 416 has holes (slits) 442 having a length of 6 mm and a width of 2 mm so that a check valve circular portion 444 made of polyimide with a diameter of 4 mm remains at the center portion of the slits 442. The liquid in the liquid chamber flows in an H direction or an L direction through the holes 442. The first check valve member 416 illustrated in FIGS. 2A and 2B is described in a cross-section taken along the line B-B.

Since the first check valve member 416 has the axially-symmetric holes 442, the liquid smoothly flows in the suction chamber 414 in the H direction or the L direction. The first check valve member 416 having the peripheral frame portion having a width of 9 mm is confined in a narrow space of the suction chamber 414 having a width of 9.2 mm and a height of 0.2 mm and is thus configured to move in parallel to the height direction in accordance with the flow of the liquid. Since the first check valve member 416 smoothly moves in the suction chamber 414 in accordance with the flow of the liquid, the flow rate of the liquid may be easily increased compared to a fixed-type check valve according to the related art.

Figure 4A:
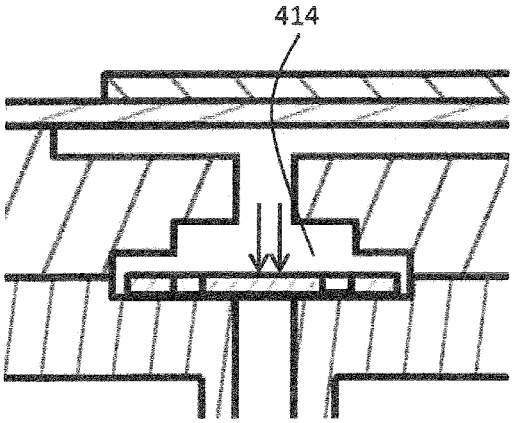
FIGS. 4A and 4B are cross-sectional views of a liquid suction side of the piezoelectric pump according to the embodiment.
Figure 4B:
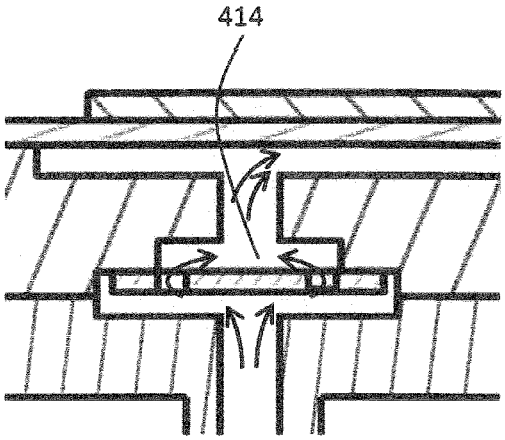

When the piezoelectric pump 400 suctions the liquid from the inlet port 412 (see FIGS. 2B and 4B), the piezoelectric actuator 430 extends so as to expand the volume of the pump chamber 420. When the volume of the pump chamber 420 is expanded, the internal pressure in the pump chamber 420 is reduced and the liquid flows into the suction chamber 414 through the first liquid communication passage 295. The first check valve member 416 is lifted in the H direction by the flowing liquid. The peripheral frame portion of the first check valve member 416 is caught by an upper wall of the first recessed portion 430, and the liquid flows into the pump chamber 420 through the holes 442. In contrast, when the piezoelectric pump 400 discharges the liquid from the liquid feed port 428 (see FIGS. 2A and 4A), the piezoelectric actuator 430 contracts so as to reduce the volume of the pump chamber 420. When the volume of the pump chamber 420 is reduced, the internal pressure in the pump chamber 420 is increased and the liquid flows into the suction chamber 414 from the first communication hole 418. The first check valve member 416 is moved in the L direction by the flowing liquid such that the check valve circular portion 444 blocks the inlet port 412. According to the operation of the first check valve member 416, the liquid flows in one direction from the first liquid communication passage 295 to the pump chamber 420.

In the liquid feed chamber 424, a second check valve member 426 having the same structure as the first check valve member 416 is provided. The liquid feed chamber 424 has the same shape and the same size as those of the suction chamber 414 and has an inverted shape with respect to the flow direction of the liquid. In accordance with the liquid flowing into the liquid feed port 428 from the second communication hole 422, the second check valve member 426 moves in the H direction or the L direction without inclined in the liquid feed chamber 424.

The flow of the liquid in the liquid feed chamber 424 is described. When the piezoelectric pump 400 suctions the liquid from the inlet port 412 (see FIG. 2B), the volume of the pump chamber 420 is expanded. As the internal pressure in the pump chamber 420 is reduced, the liquid tries to flow from the liquid feed chamber 424 toward the pump chamber 420. The second check valve member 426 has been moved in the H direction by the liquid that returns to the pump chamber 420 such that the check valve circular portion 444 blocks the second communication hole 422. Since the second communication hole 422 is blocked, the liquid flows into the pump chamber 420 from the suction chamber 414. In contrast, when the piezoelectric pump 400 discharges the liquid from the liquid feed port 428 (see FIG. 2A), the volume of the pump chamber 420 is reduced. As the internal pressure in the pump chamber 420 is increased, the liquid flows into the liquid feed chamber 424 from the second communication hole 422. The second check valve member 426 is moved in the L direction by the flowing liquid and thus the peripheral frame portion of the second check valve member 426 is caught by a bottom wall of the fifth recessed portion 438. As a result the liquid is fed into the liquid feed port 428 through the holes 442. Therefore, according to the operation of the second check valve member 426, the liquid flows in one direction from the pump chamber 420 to the liquid feed port 428.

As the materials of the first and second check valve members 416 and 426, the polyimide material is used. The reason why the polyimide material is used is that polyimide has durability against various types of ink materials discharged by an ink jet recording apparatus, such as a water-based ink, an oil-based ink, an ink containing a volatile solvent, and an UV ink. In addition, the materials of the first and second check valve members 416 and 426 may have rigidity so that the Young's modulus thereof is equal to or higher than $1\times10^7$ Pa. A check valve member in the range of the Young's modulus is effective to open and close the inlet port 412, the liquid feed port 428, the first communication hole 418, and the second communication hole 422 by transporting the ink through the holes 442 in the suction chamber 416 and the liquid feed chamber 424. Instead of the polyimide, resins or metals having strong resistance to ink, for example, polyethylene terephthalate (PET), ultra-high-molecular-weight polyethylene (PE), polypropylene (PP), polyphenylene sulfide (PPS), polyether ether ketone (PEEK), tetrafluoroethylene-perfluoroalkyl vinyl ether copolymer (PFA), tetrafluoroethylene-hexafluoropropylene copolymer (FEP), ethylene-tetrafluoroethylene copolymer (ETFE), polytetrafluoroethylene (PTFE), aluminum, stainless steel, nickel, and the like may be used. The material of the first and second check valve members 416 and 426 is not limited to the same material, and materials selected from the resins and the metals may be appropriately used. The thickness of the first and second check valve members 416 and 426 is about several micrometers to 1 mm and is determined in consideration of the viscosity of the liquid, the check valve member, or a pressure change that occurs in the pump chamber 420. In addition, the piezoelectric pump is not limited to transporting ink and may also be used as a general-purpose piezoelectric pump that transports various types of liquid materials such as medicine and a reagent for analysis.

Figure 5:
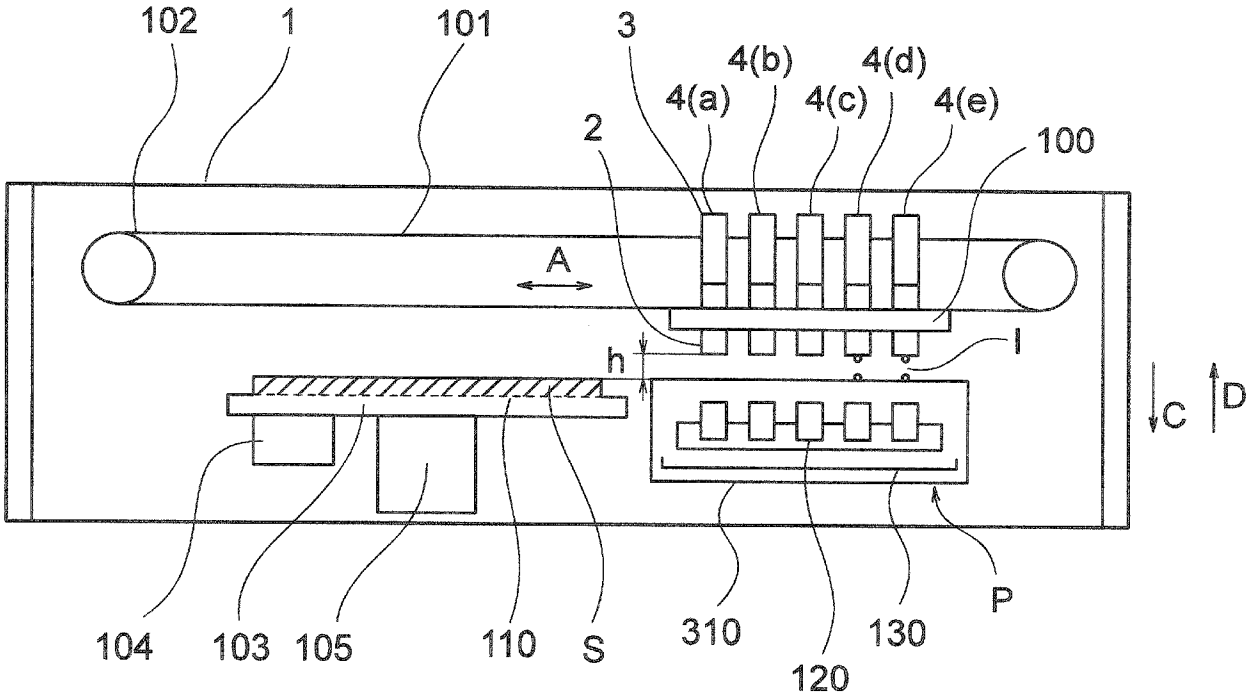
FIG. 5 is a front view of an inkjet recording apparatus according to the embodiment.

An example of an ink jet recording apparatus 1 having the piezoelectric pump 400 mounted therein will be described with reference to FIGS. 5 to 12. FIG. 5 is a front view of the ink jet recording apparatus 1. An ink supply piezoelectric pump 202 (see FIG. 9) which initially fills or replenishes an ink jet head 2 mounted in the ink jet recording apparatus 1 with ink and an ink circulation piezoelectric pump 201 (see FIG. 10) which circulates the ink that is not discharged from the ink jet head 2 and returned are mounted in the ink jet recording apparatus 1.

The number of ink colors, in this embodiment, five ink jet recording units 4(*a*) to 4(*e*) each of which includes the ink jet head 2 and an ink circulation device 3 are disposed in parallel on a carriage 100. The ink jet head 2 contains ink I (see FIGS. 7A and 7B) therein as described below and discharges the ink I from a nozzle 51 provided in a nozzle plate 52 according to an image forming signal. The ink circulation device 3 supplies the ink I to the ink jet head 2, recovers the ink I that is not discharged from the nozzle 51, and supplies the recovered ink to the ink jet head 2 again, thereby circulating the ink. The ink jet recording unit 4 (*a*) includes the ink jet head 2 that discharges the ink I downward in the direction of gravity and includes the ink circulation device 3 provided in the upper portion thereof. Each of the ink jet recording units 4 (*b*) to 4 (*e*) has the same configuration as the ink jet recording unit 4(*a*).

The ink jet recording units 4(*a*), 4(*b*), 4(*c*), and 4(*d*) respectively discharge cyan ink, magenta ink, yellow ink, and black ink. The ink jet recording unit 4(*e*) discharges white ink. The ink jet recording unit 4(*e*) discharges, as well as the white ink, a transparent glossy ink, a special ink that expresses color when irradiated with infrared rays or ultraviolet rays, or the like. The carriage 100 on which the ink jet recording units 4 (*a*) to 4 (*e*) are mounted is fixed to a transporting belt 101, and the transporting belt 101 is connected to a motor 102. By rotating the motor 102 forward or backward, the carriage 100 is reciprocated in the arrow A direction. The ink jet head recording units 4(*a*) to 4(*e*) illustrated in FIG. 5 discharge ink in the direction of gravity (in the arrow C direction).

A table 103 is a sealed container with a small-diameter hole 110 which is open to the upper surface thereof and fixes a recording medium S placed on the upper surface as a pump 104 causes the inside of the container to have a negative pressure. The recording medium. S is paper, a resin or metal film, a plate material, or the like. The table 103 is mounted on a slide rail 105 to reciprocate in the arrow B direction of FIG. 6. The ink jet head 2 includes the nozzle plate 52 in which a plurality of nozzles 51 (see FIG. 8) from which ink is discharged are formed, and a distance h between the nozzle plate 52 and the recording medium. S is maintained constant while the ink jet head 2 reciprocates. In the ink jet head 2, 300 nozzles 51 are arranged in the longitudinal direction thereof. The ink jet recording apparatus 1 forms an image while reciprocating the ink jet recording units 4(*a*) and 4(*b*) in a direction perpendicular to the transport direction of the recording medium S. That is, the longitudinal direction in which the nozzles are arranged and the transport direction of the recording medium S are the same, and the inkjet recording apparatus 1 forms an image portion on the recording medium S having the width of the 300 nozzles.

In a scanning range of the ink jet recording units 4 (*a*) to 4 (*e*) in the A direction, a maintenance unit 310 is disposed at a position outside the moving range of the table 103. A position at which the maintenance unit 310 opposes the ink jet head 2 corresponds to a standby position P of the inkjet head 2. The maintenance unit 310 is a housing with an open top and is vertically movable (in the directions of the arrows C and D of FIG. 5). If the carriage 100 is moved in the arrow A direction to form an image, the maintenance unit 310 moves downward in the C direction and is on stands by, and if the image forming operation is ended, the maintenance unit 310 moves upward in the D direction. When the image forming operation is ended, the ink jet head 2 is returned to the standby position P, and the maintenance unit 310 moves upward in the D direction to cover the nozzle plate 52 of the ink jet head 2. The maintenance unit 310 prevents the evaporation of the ink or adhesion of dust or paper powder to the nozzle plate 52 (cap function).

In the maintenance unit 310, a blade 120 made of rubber is disposed to remove ink, dust, paper powder, and the like adhered to the nozzle plate 52 of the ink jet head 2. If the carriage 100 moves in the arrow A direction to form an image, the maintenance unit 310 moves downward in the C direction such that the blade 120 is separated from the nozzle plate 52. To remove ink, dust, and paper powder adhered to the nozzle plate 52, the maintenance unit 310 moves upward in the D direction so that the blade 120 comes into contact with the nozzle plate 52. In the maintenance unit 310, a mechanism that moves the blade 120 in the B direction is disposed such that the blade 120 wipes the surface of the nozzle plate 52 and removes ink, dust, and paper powder (wiping function).

The maintenance unit 310 includes a waste ink receiving portion 130. When a maintenance operation is performed, ink is forcibly discharged from the nozzle 51 so that the ink altered in the vicinity of the nozzle is discarded and received in the waste ink receiving portion 130 (spit function). The waste ink receiving portion 130 stores the waste ink obtained by the wiping operation of the blade 120 and the waste ink obtained by the spitting operation.

Figure 6:
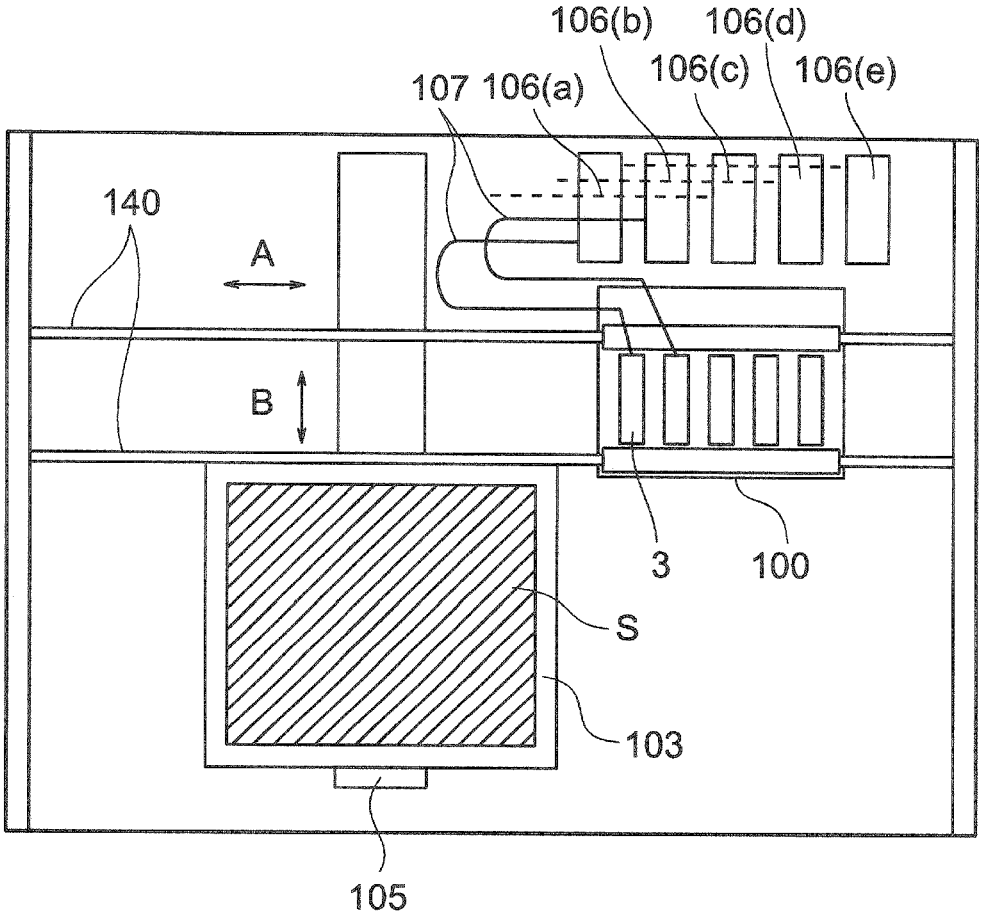
FIG. 6 is a plan view of the inkjet recording apparatus according to the embodiment.

FIG. 6 is a plan view of the inkjet recording apparatus 1.

The carriage 100 on which the ink jet recording units 4(*a*) to 4(*e*) are mounted is reciprocated in the A direction along two rails 140 in accordance with the movement of the transporting belt 101. The table 103 on which the recording medium S is mounted is reciprocated in the B direction. According to an image signal for performing printing by the ink jet recording apparatus 1, ink is discharged from the nozzle 51 while the table 103 on which the recording medium S is placed is reciprocated and the carriage 100 on which the ink jet recording units 4(*a*) to 4(*e*) are mounted is reciprocated, thereby forming an image on the entire surface of the recording medium S. A so-called serial type ink jet recording apparatus is provided.

An ink cartridge 106(*a*) is filled with cyan ink and connected to the ink circulation device 3 of the ink jet recording unit 4(*a*) via a tube 107. An ink cartridge 106(*b*) is filled with magenta ink and connected to the ink circulation device 3 of the ink jet recording unit 4(*b*) via the tube 107. In the same manner, an ink cartridge 106(*c*) is filled with yellow ink and connected to the ink circulation device 3 of the ink jet recording unit 4(*c*). An ink cartridge 106(*d*) is filled with black ink and connected to the ink circulation device 3 of the inkjet recording unit 4(*d*). An ink cartridge 106(*e*) is filled with white ink and connected to the ink circulation device 3 of the ink jet recording unit 4(*e*).

Each of the ink jet recording units 4(*a*) to 4(*e*) has a configuration that the ink circulation device 3 is stacked on the ink jet head 2. By providing the ink circulation device 3 on the inkjet head 2, an interval between the inkjet recording units 4 (*a*) to 4 (*e*) in a direction in which the inkjet recording units 4(*a*) to 4(*e*) are arranged on the carriage 100 can be reduced and the width of the carriage 100 in the transport direction (the A direction) can be shortened. The carriage 100 is transported in the A direction at least by a distance which is the sum of the maximum width of the recording medium S and a length that is twice the width of the carriage 100. Therefore, as the width of the carriage 100 is reduced, the transport direction is reduced. Accordingly, printing speed can be increased and a reduction in the size of the apparatus can be achieved.

In addition to the ink jet recording apparatus 1 which uses the moving table 103, the ink jet recording unit 4 may also be applied to an ink jet recording apparatus which performs printing by drawing out wound paper and moving an ink jet recording unit in a direction perpendicular to the drawn-out paper, or an ink jet recording apparatus which performs printing by feeding sheets using a platen roller one by one and moving an ink jet recording unit in a direction perpendicular to the sheet.

The ink jet head 2 applied to the ink jet recording apparatus 1 according to the embodiment will be described.

Figure 7A:
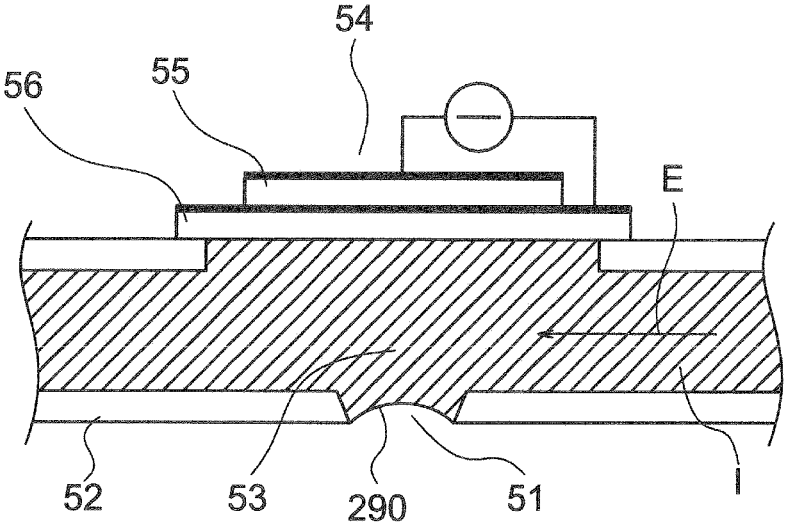
FIGS. 7A and 7B are cross-sectional views of the vicinity of a nozzle of a circulation-type ink jet head.
Figure 7B:
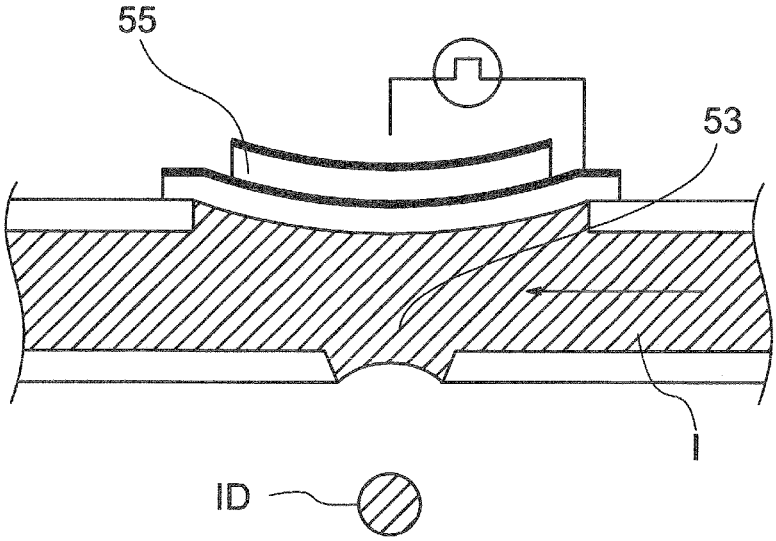

FIGS. 7A and 7B are cross-sectional views of a part of the ink jet head 2 which discharges the ink I. In the ink jet head 2, a nozzle branch portion 53 is formed on the upper surface side of the nozzle plate 52 having the nozzle 51 that discharges ink. The nozzle branch portion 53 is a portion at which the ink that flows in the arrow E direction of FIGS. 7A and 7B is divided into ink discharged from the nozzle 51 and ink that flows through the inside of the ink jet head 2 and returns to the ink circulation device 3. The ink jet head 2 has an actuator 54 on a surface thereof on a side that is opposite to the nozzle 51. The actuator 54 is a unimorph type piezoelectric vibrating plate in which a piezoelectric ceramic 55 and a vibrating plate 56 are stacked. As the piezoelectric ceramic material, PZT is used. The piezoelectric ceramic 55 is formed by forming gold electrodes on the upper and lower surfaces of the PZT and performing a polarizing treatment thereon. Thereafter, the piezoelectric ceramic 55 is adhered to the vibrating plate 56 made of silicon nitride, thereby forming the actuator 54. In addition, a meniscus 290, which is an interface between the ink and air, is formed in the ink in the nozzle 51 due to the surface tension of the ink.

FIG. 7A illustrates a state where an electric field is not applied to the piezoelectric ceramic 55 and the actuator 54 is not deformed. FIG. 7B illustrates a state in which an ink droplet ID is discharged according to the deformation of the actuator 54. When the actuator 54 is deformed by applying an electric field to the piezoelectric ceramic 55, the ink I in the nozzle branch portion 53 becomes the ink droplet ID and is discharged from the nozzle 51.

Instead of the actuator formed with the piezoelectric ceramic and the vibrating plate as described above, other actuators that generate a pressure in the ink may also be used. For example, a configuration operated such that a pressure is applied to ink by deforming a diaphragm using static electricity, a configuration operated such that pressure generated when ink I is heated by a heater and bubbles are generated in the ink (thermal method), or the like may be used as a pressure generating body.

Figure 8:
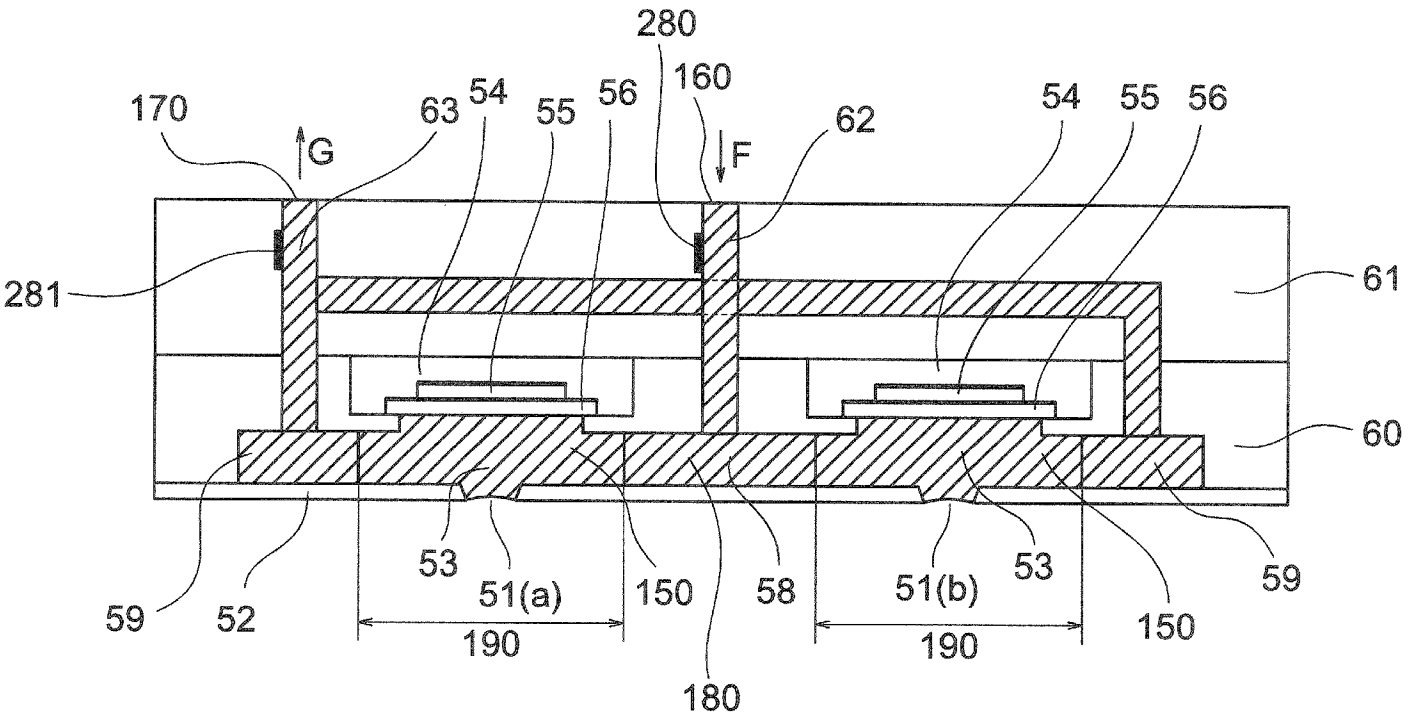
FIG. 8 is a cross-sectional view illustrating the flow of ink of the circulation-type ink jet head.

The flow of the ink in the ink jet head 2 having a part that discharge the ink illustrated in FIGS. 7A and 7B will be described with reference to FIG. 8.

The ink jet head 2 includes the nozzle plate 52, a substrate 60 including the actuator 54 illustrated in FIGS. 7A and 7B, a manifold 61, an ink supply port 160 into which the ink flows, and an ink discharge port 170 through which the ink is conveyed toward the ink circulation device 3 from the ink jet head 2.

The nozzle plate 52 includes a first nozzle row having a plurality of nozzles 51 (*a*) arranged in an inward direction of the figure and a second nozzle row having a plurality of nozzles 51 (*b*) arranged in the inward direction of the figure in the same manner. As described above, the ink I is discharged through each of the nozzles 51 (51 (*a*) and 51 (*b*)). In other words, the ink jet head 2 has a longitudinal shape in the inward direction of the figure and the nozzles 51(*a*) and 51(*b*) are disposed in the longitudinal direction thereof. The plurality of nozzles 51 (*a*) and the plurality of nozzles 51 (*b*) are disposed in the B direction (see FIG. 9) and are disposed in a direction perpendicular to the moving direction of the carriage 100.

The substrate 60 includes a flow passage 180 through which the ink flows. The nozzle plate 52 is adhered to the substrate 60 to form the flow passage 180. The actuator 54 which applies a pressure to the ink to discharge the ink is in contact with the flow passage 180 and is provided to correspond to each of the nozzles 51. A boundary wall 190 is provided between the adjacent nozzles 51 so that the pressure applied to the ink in the flow passage 180 by the actuator 54 causes the ink to be concentrated on the nozzle 51. The nozzle plate 52, the actuator 54, and the boundary wall 190 surrounding the flow passage 180 form an ink pressure chamber 150. A plurality of ink pressure chambers 150 are provided to correspond to the nozzles 51(*a*) and 51(*b*) of the first and second nozzle rows. Each of the first and second nozzle rows includes 300 nozzles. The ink I flows into the ink pressure chamber 150 from one end portion and flows out from the other end portion through the ink branch portion 53. A portion of the ink is discharged from the nozzle 51 at the ink branch portion 53 in the ink pressure chamber 150 and the remaining portion thereof flows out from the other end portion.

The flow passage 180 between the plurality of ink pressure chambers 150 formed to correspond to each of the nozzles 51 (*a*) in the first nozzle row and the plurality of ink pressure chambers 150 formed to correspond to each of the nozzles 51 (*b*) in the second nozzle row is a common ink chamber 58. The common ink supply chamber 58 is connected to one inlet port of the ink pressure chamber 150 to supply ink to the entire ink pressure chamber 150.

Ink that flows out from the other end side of the plurality of ink pressure chambers 150 corresponding to the first nozzle row and the plurality of ink pressure chambers 150 corresponding to the second nozzle row flows into a common ink chamber 59 connected to the first nozzle row and a common ink chamber 59 connected to the second nozzle row, respectively. The common ink chamber 59 is a portion of the flow passage 180 provided in the substrate 60.

The manifold 61 is connected to the substrate 60 to supply the ink to the flow passage 180. The manifold 61 includes the ink supply port 160 into which the ink is flows in the arrow F direction and an ink distribution passage 62 which is connected to the common ink supply chamber 58 from the ink supply port 160. In order to detect the temperature of the ink supplied to the ink jet head 2, a head temperature sensor (upstream) 280 is disposed along the ink distribution passage 62. In addition, the manifold 61 includes the ink discharge port 170 which discharges the ink in the arrow G direction and an ink circulation passage 63 which is connected to the ink discharge port 170 from the two common ink chambers 59. In order to detect the temperature of the ink discharged from the inkjet head 2, a head temperature sensor (downstream) 281 is disposed along the ink circulation passage 63. The temperatures of the ink supplied to the ink jet head 2 and discharged from the ink jet head 2 are detected by the head temperature sensor (upstream) 280 and the head temperature sensor (downstream) 281, respectively, so that the ink circulation device 3 is controlled in consideration of a change in the ink viscosity due to the temperature of the ink in the ink jet head 2.

The ink I moves in the ink jet head 2 in the order of the ink supply port 160, the ink distribution passage 62, the common ink supply chamber 58, the ink pressure chambers 150, the common ink chamber 59, the ink circulation passage 63, and the ink discharge port 170. A portion of the ink I is discharged from the nozzles 51 according to an image signal and the remaining ink I is conveyed toward the ink circulation device 3 from the ink discharge port 170.

The ink circulation device 3 will be described with reference to FIGS. 9 to 11.

Figure 9:
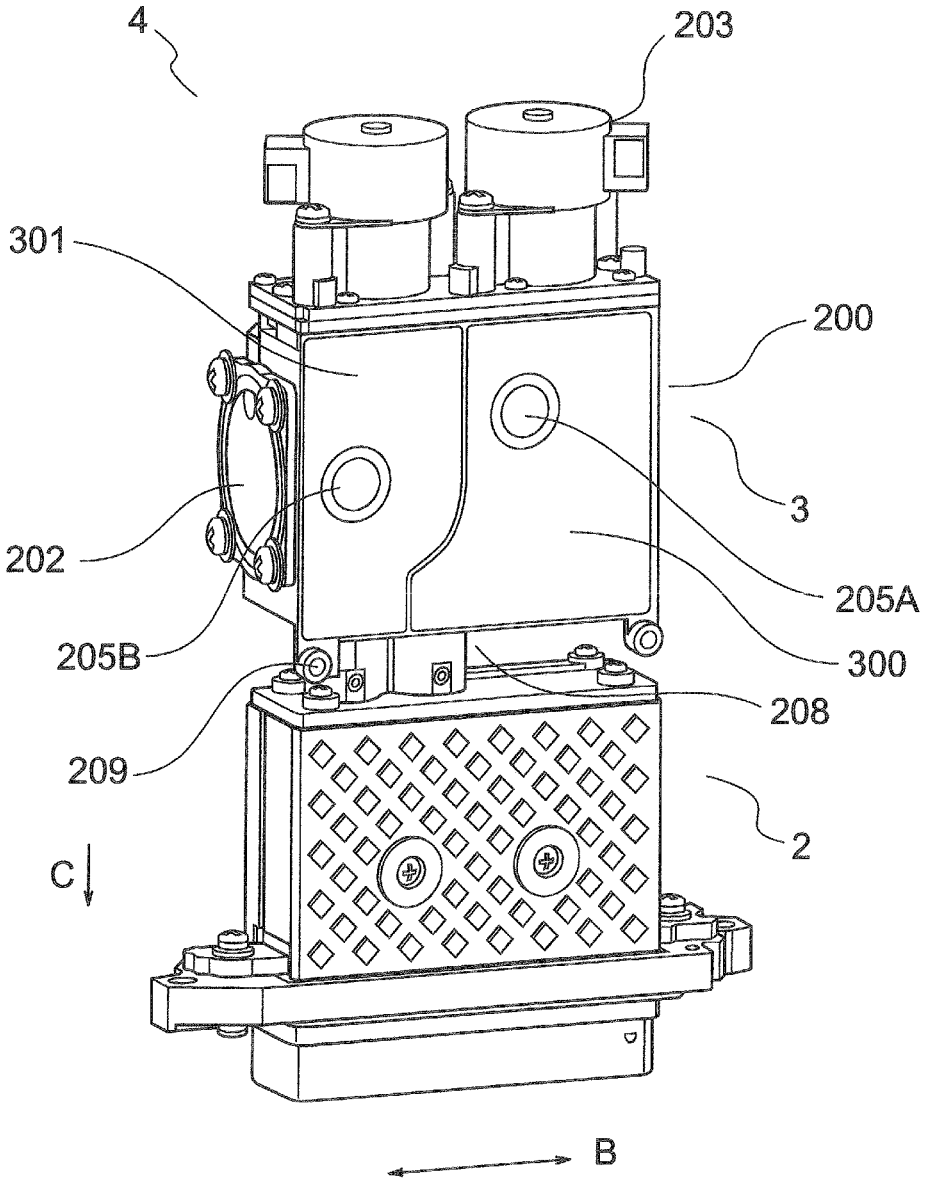
FIG. 9 is a perspective view of an ink circulation device according to the embodiment from one side.

FIG. 9 illustrates the ink jet recording unit 4 in which the ink circulation device 3 is disposed above the ink jet head 2 and the ink circulation device 3 and the ink jet head 2 are integrated with each other. FIG. 10 is a view of the ink jet recording unit 4 viewed in a direction opposite to that of FIG. 9. FIG. 11 is a cross sectional view of the inkjet head 2 and the ink circulation device 3 from the front side.

The ink circulation device 3 includes an ink casing 200, an ink supply pipe 208 to supply the ink to the ink jet head 2, an ink return pipe 209 through which the ink returns from the ink jet head 2, and a pressure adjusting unit 203 which adjusts the pressure in the ink casing 200 to appropriately maintain the ink pressure at the nozzle 51 of the inkjet head 2. The ink circulation device 3 feeds the ink downward (in the arrow C direction which is the direction of gravity) through the ink supply pipe 208, and the inkjet head 2 discharges the ink further downward.

On the outer wall surface of the ink casing 200, the ink supply pump 202 which supplies the ink into the ink casing 200 with an amount of ink consumed for printing, the maintenance operation, or the like is provided. In order to store the ink I in the ink casing 200, a supply-side ink chamber 210 and a recovery-side ink chamber 211 are provided and are sealed by a first plate 300 that covers the recovery-side ink chamber 211 and a second plate 301 that covers the supply-side ink chamber 210. The ink supply pump 202 supplies the ink to the recovery-side ink chamber 211.

An ink amount sensor 205A which measures the amount of ink in the ink casing 200 is attached to the first plate 300 which seals the ink casing 200. An ink amount sensor 205B is attached to the second plate 301. An ink amount sensor 205C has includes a piezoelectric vibrating plate that is attached to the ink casing 200 and vibrated by an AC voltage to vibrate the ink in the ink casing 200. The vibration of the ink transmitted to the inside of the ink casing 200 due to the ink amount sensor 205C is detected by the ink amount sensors 205A and 205B to measure the ink amount.

A space above an ink liquid level a of the ink in the supply-side ink chamber 210 and a space above the ink liquid level b of the ink in the recovery-side ink chamber 211 are air spaces. In order to detect the air pressures in the upper portions of the supply-side ink chamber 210 and the recovery-side ink chamber 211, the ink circulation device 3 includes a pressure sensor 204. The detecting unit of the pressure sensor 204 is connected to the air space in the recovery-side ink chamber 211 through a communication hole 223 and connected to the air space in the supply-side ink chamber 210 through a communication hole 222 to measure the pressures of the air in the two ink chambers. The pressure sensor 204 outputs the air pressures in the supply-side ink chamber 210 and the recovery-side ink chamber 211 as an electrical signal and is connected to a control board 500 (see FIG. 9), which will be described below. In addition, the pressure sensor 204 includes two pressure detecting ports in a single chip to detect the air pressures in the two ink chambers (the supply-side ink chamber 210 and the recovery-side ink chamber 211) in the ink casing 200.

In order to adjust the viscosity of the ink in the ink casing 200, a heater 207 for heating the ink is provided outside the ink casing 200. The heater 207 is attached to the ink casing 200 with an adhesive having high thermal conductivity. An ink temperature sensor 282 is attached to the ink casing 200 in the vicinity of the heater 207. The ink temperature sensor 282 and the heater 207 are connected to the control board 500, and the heater 207 is controlled to achieve a desired ink viscosity during printing.

Hereinafter, each element of the ink circulation device 3 will be described in detail.

The ink supply pump 202 illustrated in FIG. 9 is attached to the outer wall of the ink circulation device 3 of the ink jet recording unit 4. The tube 107 to convey the ink to the ink circulation device 3 from the ink cartridge 106 is connected to an ink replenishing port 221. The ink replenishing port 221 is an ink inlet port through which the ink flows into the ink supply pump 202. The ink supply pump 202 supplies the ink from the ink replenishing port 221 to the recovery-side ink chamber 211 of the ink circulation device 3.

The ink supply pump 202 and the ink circulation piezoelectric pump 201, which will be described below, are piezoelectric pumps having the above-described configuration. Elements that have the same functions as those of the piezoelectric pump described with reference to FIGS. 1 to 4 are denoted by reference numerals used for the ink circulation device 3, to describe the ink supply piezoelectric pump 202 and the ink circulation piezoelectric pump 201 disposed in the ink circulation device 3.

The ink supply pump 202 periodically changes the volume (pump chamber 240) in the pump using a piezoelectric actuator to transport the ink in one direction by two check valve members. One check valve member 242 of the ink supply pump 202 is provided between the ink replenishing port 221 and the pump chamber 240, and the other check valve member 243 is provided between the pump chamber 240 and an ink outlet 241. When the piezoelectric actuator is bent and the volume of the pump chamber 240 expands, the check valve member 242 is moved to allow the ink to flow into the pump chamber 240, and the check valve member 243 is closed. When the piezoelectric actuator is bent in the opposite direction and the volume of the pump chamber 240 contracts, the check valve member 242 is closed and the check valve member 243 is opened to allow the ink to flow out from the pump chamber 240. By repeating this operation, the ink is fed.

The ink cartridge 106 which supplies the ink to the recovery-side ink chamber 211 is disposed in a relatively lower portion in the direction of gravity (C direction) with respect to the ink circulation device 3. As the cartridge 106 is disposed in the lower portion, the head pressure of the ink in the cartridge 106 is maintained in a level lower than a set pressure of the ink in the recovery-side ink chamber 211. With this configuration, the ink I is supplied to the recovery-side ink chamber 211 only when the ink supply pump 202 is driven.

In addition, if the ink cartridge 106 is disposed at a position higher than the recovery-side ink chamber 211, the head pressure of the ink in the ink cartridge 106 becomes higher than the set pressure of the ink in the recovery-side ink chamber 211. In this case, for example, a solenoid valve is used instead of the ink supply pump 202 to generate a head pressure difference between the ink in the ink cartridge 106 and the ink in the recovery-side ink chamber 211 only when the valve is opened. The ink may be supplied using the head pressure difference.

Figure 10:
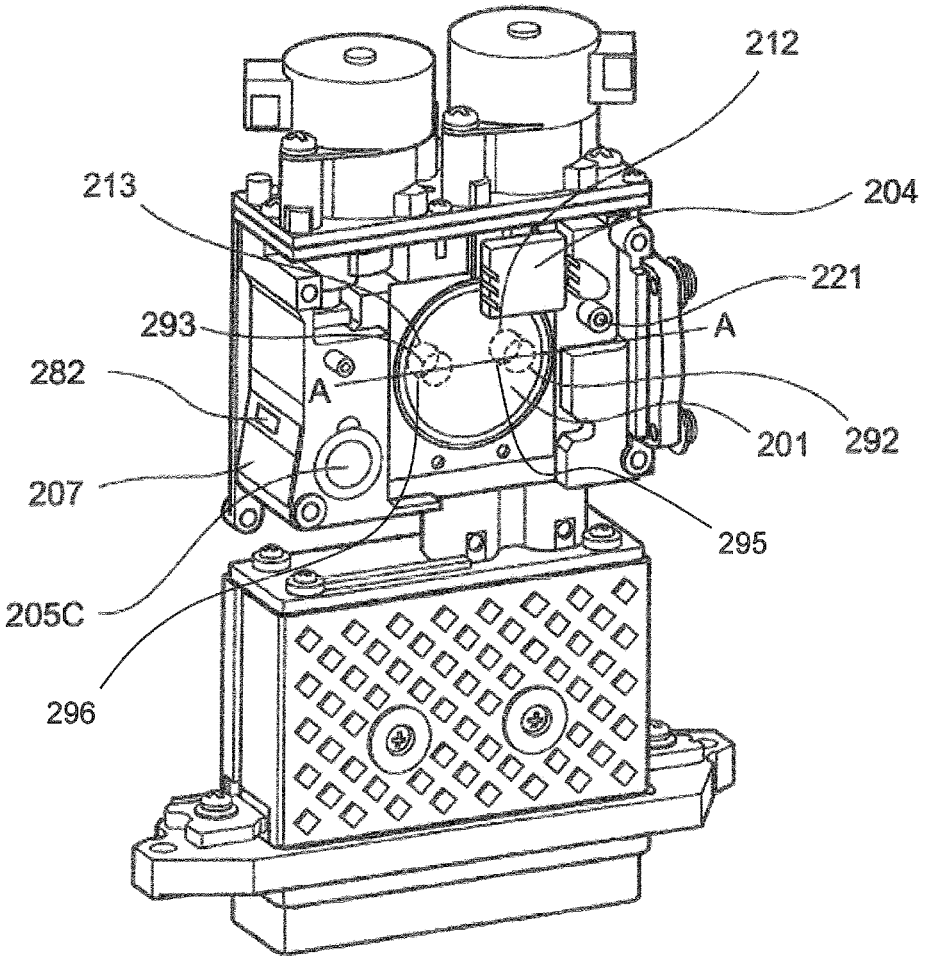
FIG. 10 is a perspective view of the ink circulation device according to the embodiment from an opposite side.

As illustrated in FIG. 10, the ink circulation pump 201 is provided on a surface opposite to the surface of the first plate 300 that covers the recovery-side ink chamber 211 and the second plate 301 that covers the supply-side ink chamber 210. The control board 500, which will be described below, is held in the ink jet recording unit 4 to cover the ink circulation pump 201. The control board 500 controls the ink circulation pump 201, the ink supply pump 202, and the pressure adjusting unit 203.

As illustrated in FIG. 10, the ink circulation pump 201 includes an inlet port 292 which receives the ink and an outlet port 293 which discharges the ink. The ink circulation pump 201 suctions the ink I from a suction hole 212 of the recovery-side ink chamber 211 via the inlet port 292 and the ink communication passage 295 and flows out the ink I to the supply-side ink chamber 210 from a discharge hole 213 via the ink communication passage 296 and the outlet port 293. The internal pressure in the sealed supply-side ink chamber 210 is increased as the amount of the ink increases, and the ink I flows into the ink jet head 2 through the ink supply pipe 208. In FIG. 10, the suction hole 212, the ink communication passage 295, the inlet port 292, the outlet port 293, the ink communication passage 296, and the discharge hole 213 are illustrated by broken lines.

Figure 11:
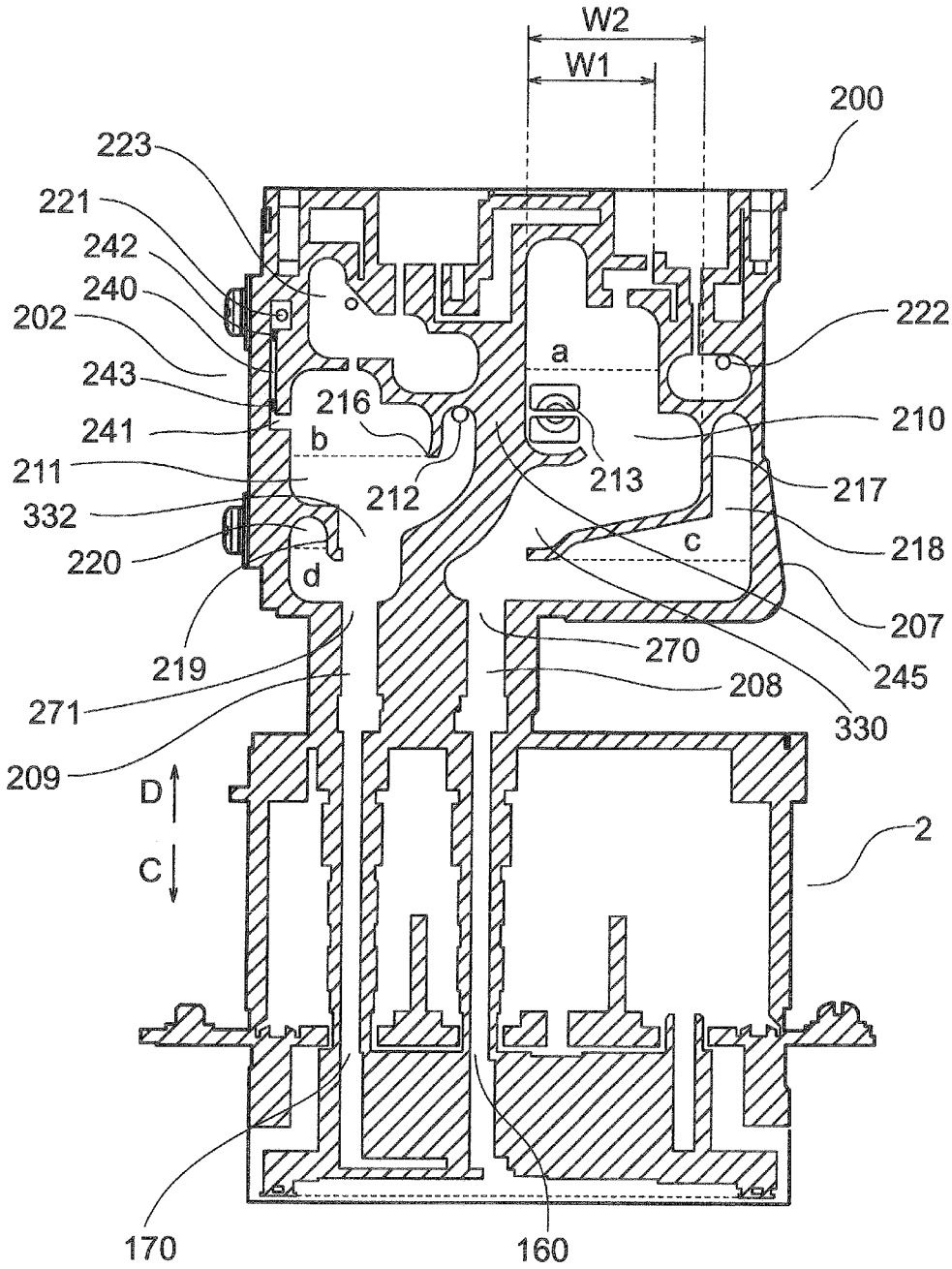
FIG. 11 is a cross-sectional view of the ink circulation device and the ink jet head according to the embodiment.

FIG. 11 is a cross sectional view of the ink circulation device 3 from a front side.

The ink casing 200 of the ink circulation device 3 includes the supply-side ink chamber 210 which supplies the ink to the ink jet head 2 via the ink supply pipe 208 and the recovery-side ink chamber 211 to which the ink returns from the ink jet head 2 via the ink return pipe 209. The ink casing 200 is formed of aluminum. The ink casing 200 has a space for the supply-side ink chamber 210, and the resin plate 300 (the first plate) is fixed to a frame that forms the space for the supply-side ink chamber 210 with an adhesive, thereby forming the supply-side ink chamber 210. Similarly, in order to form the recovery-side ink chamber 211 of the ink casing 200, the resin plate 301 (the second plate) is fixed to a frame for the recovery-side ink chamber 211 with an adhesive. The material of the resin plates 300 and 301 is a polyimide resin.

Alternatively, the ink casing 200 maybe formed of a metal or a resin instead of aluminum as long as the material does not alter the ink. As the metal material, stainless steel, brass, and the like may be used. As the resin material, acrylonitrile butadiene styrene (ABS), an epoxy resin, polycarbonate, and the like may be used. Instead of the polyimide resin of the resin plates 300 and 301, polyethylene terephthalate (PET), polyamide, aluminum, stainless steel, brass, and the like may be used.

In the ink casing 200, the recovery-side ink chamber 211 and the supply-side ink chamber 210 are provided integrally with each other via a common wall 245. The disposition direction of the recovery-side ink chamber 211 and the supply-side ink chamber 210 is the same as the disposition direction of the nozzles of the ink jet head 2 (the longitudinal direction (B direction in FIG. 9) of the ink jet head 2). That is, the disposition direction of the recovery side ink chamber 211 and the supply side ink chamber 210 provided above the ink jet head 2 is in a direction substantially perpendicular to the scanning direction of the carriage 100.

By disposing the recovery-side ink chamber 211 and the supply-side ink chamber 210 in a direction substantially at a right angle with respect to the scanning direction of the carriage 100, the following advantages are obtained. When the carriage 100 starts or stops the scanning operation, the carriage 100 is accelerated or decelerated. During the acceleration or deceleration of the carriage 100, the ink surfaces (the liquid levels a and b) in the recovery-side ink chamber 211 and the supply-side ink chamber 210 change. Since the recovery-side ink chamber 211 and the supply-side ink chamber 210 are disposed in a direction substantially at a right angle with respect to the scanning direction, the ink liquid levels a and b substantially equally change. Since the difference between the liquid levels a and b is small, the shape of the ink meniscus 290 of the ink jet head 2 which is positioned between the recovery-side ink chamber 211 and the supply-side ink chamber 210 changes little. Since a change in the shape of the meniscus 290 is small, the discharge of the ink from the nozzle 51 is stabilized even during the acceleration or deceleration of the carriage 100.

An ink jet recording apparatus 1 having the recovery-side ink chamber 211 and the supply-side ink chamber 210 that are disposed in the same direction as the scanning direction of the carriage 100 above the ink jet head 2 is assumed here. It is assumed that the recovery-side ink chamber 211 is disposed closer to the recording medium S than the standby position P of the ink jet head 2 while the supply-side ink chamber 210 is disposed on a side opposite to the recording medium S. When the ink jet recording unit 4 is accelerated in a direction toward the recording medium S from the standby position P, the ink in the recovery-side ink chamber 211 flows into the supply-side ink chamber 210 through the ink circulation pump 201. In addition, when the carriage 100 stops to scan the recording medium S, the ink jet recording unit 4 is decelerated. During the deceleration, the ink flows into the recovery-side ink chamber 211 from the supply-side ink chamber 210 through the ink circulation pump 201. As the ink flows in and out between the recovery-side ink chamber 211 and the supply-side ink chamber 210, the ink at the meniscus 290 is pulled into the nozzle 51 or is pushed out of the nozzle 51. A change in the shape of the meniscus 290 affects the amount of discharged ink. Therefore, when the recovery-side ink chamber 211 and the supply-side ink chamber 210 are disposed in a direction substantially at a right angle with respect to the scanning direction of the carriage 100, the ink discharge is stabilized relative to when the recovery-side ink chamber 211 and the supply-side ink chamber 210 are disposed in the same direction as the scanning direction of the carriage 100.

In addition, in the ink jet recording apparatus 1, the five ink jet recording units 4 including the inkjet recording units 4(*a*) to 4(*e*) are disposed in the scanning direction of the carriage 100. By disposing the recovery-side ink chamber 211 and the supply-side ink chamber 210 in a direction substantially at a right angle with respect to the scanning direction of the carriage 100, the width of the ink jet recording units 4 in the scanning direction of the carriage 100 can be reduced compared to the ink jet recording apparatus in which the recovery-side ink chamber 211 and the supply-side ink chamber 210 are disposed in the same direction as the scanning direction of the carriage 100, thereby achieving a reduction in the size of the ink jet recording apparatus 1.

The ink casing 200 includes the suction hole 212 which suctions the ink from the recovery-side ink chamber 211 and the discharge hole 213 which discharges the ink to the supply-side ink chamber 210. The recovery-side ink chamber 211 and the supply-side ink chamber 210 are adjacent to each other via the common wall 245. The ink circulation pump 201 is provided to cross the recovery-side ink chamber 211 and the supply-side ink chamber 210 which are adjacent to each other. The inlet port 292 of the ink circulation pump 201 and the suction hole 212 of the ink casing 200 are connected with the first ink communication passage 295. In addition, the outlet port 293 of the ink circulation pump 201 and the discharge hole 213 of the ink casing 200 are connected with the second ink communication passage 296. The first and second ink communication passages 295 and 296 are orthogonally provided with respect to the ink circulation pump 201 having a flat plate shape and are connected substantially horizontally to the recovery-side ink chamber 211 in the ink casing 200. The ink is horizontally transported to the supply-side ink chamber 210 from the ink circulation pump 201 through the second ink communication passage 296.

In this embodiment, the first and second ink communication passages 295 and 296 are provided in the ink circulation pump 201. Alternatively, the first and second ink communication passages 295 and 296 may be provided in the ink casing 200. By reducing the lengths of the first and second ink communication passages 295 and 296 as much as possible, the size of the ink circulation device 3 may be reduced.

The ink circulation pump 201 is the piezoelectric pump described above. The ink circulation pump 201 periodically changes the volume (pump chamber 324) in the pump as the piezoelectric actuator is bent to transport the ink and allows the ink conveying direction to be in one direction by two check valve members. One check valve member (A) 326 of the ink circulation pump 201 is provided between the suction hole 212 and the pump chamber 324, and the other check valve member (B) 328 is provided between the pump chamber 324 and the discharge hole 213. When the ink flows into the pump chamber 324, the check valve member (A) 326 is open and the check valve member (B) 328 is closed. When the ink flows out from the pump chamber 324, the check valve member (A) 326 is closed and the check valve member (B) 328 is open. By repeating this operation, the ink is supplied into the supply-side ink chamber 210 from the recovery-side ink chamber 211.

In this embodiment, the first and second ink communication passages 295 and 296 are horizontally held at the same distance from the nozzle plate 52, and the inlet port 292 and the outlet port 293 are also held at the same distance from the nozzle plate 52. Instead of this configuration, the distance from the nozzle plate 52 to the outlet port 293 may be greater than the distance from the nozzle plate 52 to the inlet port 292. That is, the outlet port 293 may be provided at a position higher than the inlet port 292 in the direction of gravity (C direction). When the position of the outlet port 293 is high, even when bubbles are included in the air in the pump chamber 324 from the inlet port 292, the bubbles may be easily discharged from the outlet port 293.

When the ink circulation pump 201 having the above configuration is operated, the ink is suctioned into the suction hole 212 from the recovery-side ink chamber 211 and is transported to the supply-side ink chamber 210 through the ink circulation pump 201 and the discharge hole 213. The internal pressure in the sealed supply-side ink chamber 210 is increased as the amount of ink therein increases, and the ink flows into the ink jet head 2 through the ink supply pipe 208.

The supply-side ink chamber 210 has a function of removing bubbles contained in the flowing ink. The flow speed of the ink that flows in the supply-side ink chamber 210 is a value obtained by dividing a flow rate by the cross-sectional area of the supply-side ink chamber 210 in the horizontal direction in FIG. 11. The bubbles in the ink move upward in the direction (D direction), which is opposite to the direction of gravity, due to buoyancy. If the speed of the bubbles that move upward due to the buoyancy is higher than the speed of bubbles that is conveyed downward in a direction toward the ink supply pipe 208, the bubbles move upward in the ink. As described below, the amount of ink in the supply-side ink chamber 210 is maintained at the liquid level a. Therefore, the bubbles reach the air space above the liquid level a in the upper portion of the supply-side ink chamber 210 and are removed from the ink. In order to easily remove the bubbles, the shape of the supply-side ink chamber 210 is formed so that the flow speed of the ink that flows in the direction toward the ink supply pipe 208 is slow. A cross-sectional area W2 below (C direction) the discharge hole 213 is greater than a cross-sectional area W1 above (D direction) the discharge hole 213 which is connected to the supply-side ink chamber 210. The ratio of the cross-sectional areas W1 and W2 is determined in consideration of the ink viscosity or the ink flow speed.

The recovery-side ink chamber 211 also has a function of removing bubbles contained in the ink flowing from the ink jet head 2. The bubbles suctioned from the nozzle 51 of the ink jet head 2 flow into the recovery-side ink chamber 211 from the ink return pipe 209. The bubbles move upward (D direction) due to the flow of the ink and buoyancy. The bubbles suctioned into the ink moves upward in a substantially vertical direction from the connection portion of the ink return pipe 209, which is connected to the recovery-side ink chamber 211. The bubbles that move upward pass through the liquid level b and are introduced into the air space. The suction hole 212 is disposed at a position shifted in the horizontal direction from the path of the bubbles that move upward. Therefore, the bubbles suctioned into the ink are unlikely to move toward the supply-side ink chamber 210. Moreover, as illustrated in FIG. 11, a wall portion 216 which partitions a portion of the recovery-side ink chamber 211 is provided at a position shifted from the connection portion of the ink return pipe 209 which is connected to the recovery-side ink chamber 211 in the horizontal direction. Since the wall portion 216 is provided to partition the path of the bubbles and the suction hole 212, the bubbles suctioned into the ink are less likely to move into the suction hole 212.

When bubbles are contained in the ink, the ink that contains the bubbles flow into the ink jet head 2. When the ink containing the bubbles flows into the ink pressure chamber 150, a pressure applied to discharge the ink is applied to the bubbles instead. Therefore, the pressure is not properly applied to the ink and discharge failure may occur. The discharge failure refers to a state in which the ink is not be discharged from the nozzle 51, a state in which a discharge speed at which the ink is discharged from the nozzle 51 is insufficient and thus an ink droplet is not landed on a desired position in the recording medium S, and the like. By removing the bubbles from the ink in the recovery-side ink chamber 211 and the supply-side ink chamber 210, the ink that does not contain the bubbles is supplied to the ink pressure chamber 150 in the ink jet head 2 and thus the ink discharge failure may be suppressed.

In the supply-side ink chamber 210, an air chamber 218 (first air chamber) partitioned by a wall portion 217 is provided between the discharge hole 213 and the ink supply pipe 208. The ink fed from the ink circulation pump 201 through the outlet port 293 is fed to the ink jet head 2 through the discharge hole 213, the supply-side ink chamber 210, and a first ink path 330 of the ink supply pipe 208. The ink flows downward (C direction) in the direction of gravity along the first ink path 330. That is, the ink is transported horizontally in the ink communication passage 296 and the transport direction thereof is bent substantially at a right angle from the discharge hole 213 to the supply-side ink chamber 210. Then, the ink moves downward along the first ink path 330. The wall portion 217 is formed integrally with the ink casing 200 made of aluminum. The thickness of the wall portion 217 is determined in consideration of the volume of the supply-side ink chamber 210 and the volume of the air chamber 218. The wall portion 217 is provided above (D direction) an opening 270 so as not to block the opening 270 of the ink supply pipe 208 and is configured so that the ink easily flows into the opening 270 from the supply side ink chamber 210.

The ink is supplied from the ink circulation pump 201 to the supply-side ink chamber 210 through the discharge hole 213. The discharge hole 213 is provided above (D direction) the wall portion 217 that partitions the supply-side ink chamber 210 in the direction of gravity. Furthermore, since the wall portion 217 is provided above (D direction) the opening 270 as described above, the ink is stored in the supply-side ink chamber 210 on the lower side (C direction) in the direction of gravity from the wall portion 217. In other words, a liquid level c, which is a boundary surface of the air chamber 218, is formed between the discharge hole 213 and the opening 270 of the ink supply pipe 208. The space above the liquid level c, which is the boundary surface between the air chamber 218 and the ink in the supply-side ink chamber 210, is filled with air. The air chamber 218 includes air that exists in a region partitioned by the wall portion 217 when the ink is initially introduced into the ink jet recording unit 4 which will be described below. The air chamber 218 functions as a damper that absorbs a pressure change in the ink.

The air chamber 218 is generally provided between the discharge hole 213 that is connected to the ink circulation pump 201 and the opening 270 of the ink supply pipe 208 that supplies the ink to the supply side ink chamber 2. Although the air chamber 218 is filled with the air that exists when the ink is initially introduced, nitrogen or a noble gas that is less likely to react with the ink may be introduced. When the air in the ink jet recording unit 4 is replaced with nitrogen or the noble gas before initially introducing the ink and the ink is supplied to the ink jet recording unit 4 after the replacement, the air chamber 218 may be filled with nitrogen or the noble gas.

The amount of the initially introduced ink that flows from the discharge hole 213 to the supply-side ink chamber 210 is changed according to the vibration cycle of the piezoelectric vibrating plate of the ink circulation pump 201, and thus a pressure of the ink in the supply-side ink chamber 210 changes. The effect of the pressure change is extended to the meniscus 290, which is the interface between the ink in the nozzle 51 and the air, through the ink supply pipe 208 and the ink pressure chamber 150. The shape of the meniscus 290 affects the amount of discharged ink. When the amount of discharged ink is changed, the size of each pixel on the recording medium S changes, resulting in deterioration of image quality. Since the air chamber 218 which functions as a damper is provided between the discharge hole 213 and the ink supply pipe 208, the pressure change of the ink due to the ink circulation pump 201 may be absorbed by a change of the volume of the air in the air chamber 218. By reducing the pressure change in the ink, variations of the shape of the meniscus 290 is suppressed, thereby obtaining good image quality.

A path through which the ink flows in the order of the ink discharge port 170 of the ink jet head 2, the ink return pipe 209, the recovery side ink chamber 211, and the suction hole 212 is a second ink path 332. The ink flows upward (D direction) in the direction of gravity along the second ink path 332. Next, the direction in which the ink flows is changed at a right angle so that the ink flows into the suction hole 212. The ink flowing from the suction hole 212 is transported to the ink circulation pump 201 through the ink communication passage 295 that is horizontally arranged.

If bubbles are contained in the ink that returns from the ink jet head 2, the bubbles are moved upward due to the flow of the ink and buoyancy because the ink flows upward (D direction) in the direction of gravity in the ink return pipe 209 and the second ink path 332 of the recovery side ink chamber 211. While the bubbles flow vertically upward in the ink return pipe 209 due to the buoyancy, the suction hole 212 is disposed so that the ink flows horizontally to the ink circulation pump 201, and thus bubbles reach the air space above the liquid level in the recovery-side ink chamber 211. As a result, the bubbles are suppressed from being suctioned into the ink circulation pump 201. The bubbles are not contained in the ink that flows into the ink jet head 2 and the effect of the pressure applied to the ink pressure chamber 150 may be efficiently extended to the ink. As a result, ink discharge is stabilized and thus good image quality is obtained.

In the recovery-side ink chamber 211, an air chamber 220 (second gas chamber) partitioned by a wall portion 219 is also provided between the suction hole 212 and the ink return pipe 209. The wall portion 219 is provided so as not to block the upper side (D direction) of an opening 271, which is a connection portion between the ink return pipe 209 and the recovery side ink chamber 211, and to form the air chamber 220 in the recovery-side ink chamber 211. The size of the wall portion 219 is determined in consideration of the volume of the recovery-side ink chamber 211 and the volume of the air chamber 220. In other words, the air chamber 220 is provided between the suction hole 212 and the opening 271, and a liquid level d, which is the interface between the ink and air, is maintained between the suction hole 212 and the opening 271.

Since the air chamber 220 is provided so as not to block the opening 271, even if bubbles are contained in the ink that is recovered from the ink jet head 2, the bubbles are unlikely to be collected in the air chamber 220. Therefore, the amount of air in the air chamber 220 is maintained in a generally constant level. In addition, like in the air chamber 218, the air in the air chamber 220 may be replaced with nitrogen or a noble gas.

The upper portion of the recovery-side ink chamber 211 which is above the liquid level d that is the ink interface is filled with air. Regarding the ink suctioned into the suction hole 212, the amount of suctioned ink is changed according to the vibration cycle of the piezoelectric vibrating plate of the ink circulation pump 201 and thus a pressure change occurs. This pressure change also affects the shape of the meniscus 290 at the nozzle 51 of the inkjet head 2. A change in the shape of the meniscus 290 affects the volume of the discharged ink and thus may deteriorate image quality. Since the air chamber 220 is provided between the suction hole 212 and the ink return pipe 209, the volume of the air in the air chamber 220 is changed to absorb the pressure change. Therefore, the shape of the meniscus 290 of the ink jet head 2 is not changed, and thus the amount of discharged ink may be maintained to be constant. As a result, good image quality is obtained.

The pressure adjusting unit 203 will be described. The meniscus 290 is formed in the nozzle 51 that discharges the ink out of the ink jet head 2. When the ink is discharged from the nozzle 51, the meniscus 290, which is the interface between the ink and air, is broken and becomes an ink droplet that is discharged. When the pressure applied to the ink at the meniscus 290 is higher than the air pressure (positive pressure), the ink is discharged from the nozzle 51. When the pressure of the ink at the meniscus 290 is lower than the air pressure (negative pressure), the shape of the meniscus 290 is maintained, and the ink stays in the nozzle 51. Therefore, if the ink is not discharged, the pressure of the ink in the ink pressure chamber 150 is adjusted to a range of −4.0 to −0.5 kPa to maintain the meniscus 290. Since the nozzle 51 is disposed so that the ink is discharged downward in the direction of gravity, when the pressure is higher than the range (positive pressure side), the ink is discharged from the nozzle in response to small vibration or the like. In addition, when the pressure is lower than the range (negative pressure side), the air is suctioned into the nozzle and thus discharge failure occurs. The pressure of the ink in the ink pressure chamber 150 is typically maintained at a negative pressure, and when the actuator 54 is operated, the ink in the ink pressure chamber is caused to have a positive pressure and thus the ink is discharged from the nozzle 51.

An ink amount detecting sensor 205 includes a vibration oscillator 205C which uses a piezoelectric element provided on the side surface of the ink casing 200, a vibration receiver 205A which uses a piezoelectric element attached to the resin plate 300 of the supply-side ink chamber 210, and a vibration receiver 205B which uses a piezoelectric element attached to the resin plate 301 of the recovery-side ink chamber 211. Vibrations oscillated by the vibration oscillator 205C are propagated to the vibration receivers 205A and 205B via the ink if the ink is present in the ink casing 200. The piezoelectric elements of the vibration receivers 205A and 205B are deformed by the vibrations of the ink. When the piezoelectric elements are deformed, the deformation may be detected as a voltage. If the ink is not present in the ink casing 200 or the amount of the ink in the ink casing 200 is small, the propagating vibrations are weakened and thus a voltage generated by the piezoelectric element is reduced. Based on the voltage level, the amount of ink in the supply-side ink chamber 210 and the recovery-side ink chamber 211 is detected.

A heater 207 having a heating wire that is made of SUS and disposed between resin films is attached to the side surface of the ink casing 200. In order to efficiently conduct the heat of the heater 207 to the ink, the heater 207 is attached to the aluminum part of the ink casing 200. The outer surface of the heater 207 is covered with a heat insulating cover so as not to dissipate the heat to the outside. In order to detect the temperature of the ink supplied to the ink jet head 2, a thermistor (the head temperature sensor (upstream) 280) is disposed in the ink distribution passage 62. In addition, in order to detect the temperature of the ink discharged from the ink jet head 2, a thermistor (the head temperature sensor (downstream) 281) is disposed in the ink circulation passage 63. If PZT is used as the actuator 54 of the ink jet head 2, the actuator 54 generates heat when the ink discharge operation is repeated. Since the actuator 54 that generates heat heats the ink that passes through the ink pressure chamber 150, the temperatures of the ink in both the ink distribution passage 62 and the ink circulation passage 63 are measured, and the average value thereof is determined as the ink temperature. The viscosity of the ink changes depending on the temperature. When the viscosity of the ink is changed, the discharge volume and the discharge speed of the ink are changed, which affects image concentration or image quality. In order to achieve constant image concentration or image quality, the ink temperature is adjusted by the heater 207 so that the printing operation is performed in a desired temperature range. A thermistor 282 (heater temperature sensor) is attached also to the surface of the heater 207 to stop heating when the temperature reaches a set upper limit so as not to break the device.

Figure 12:
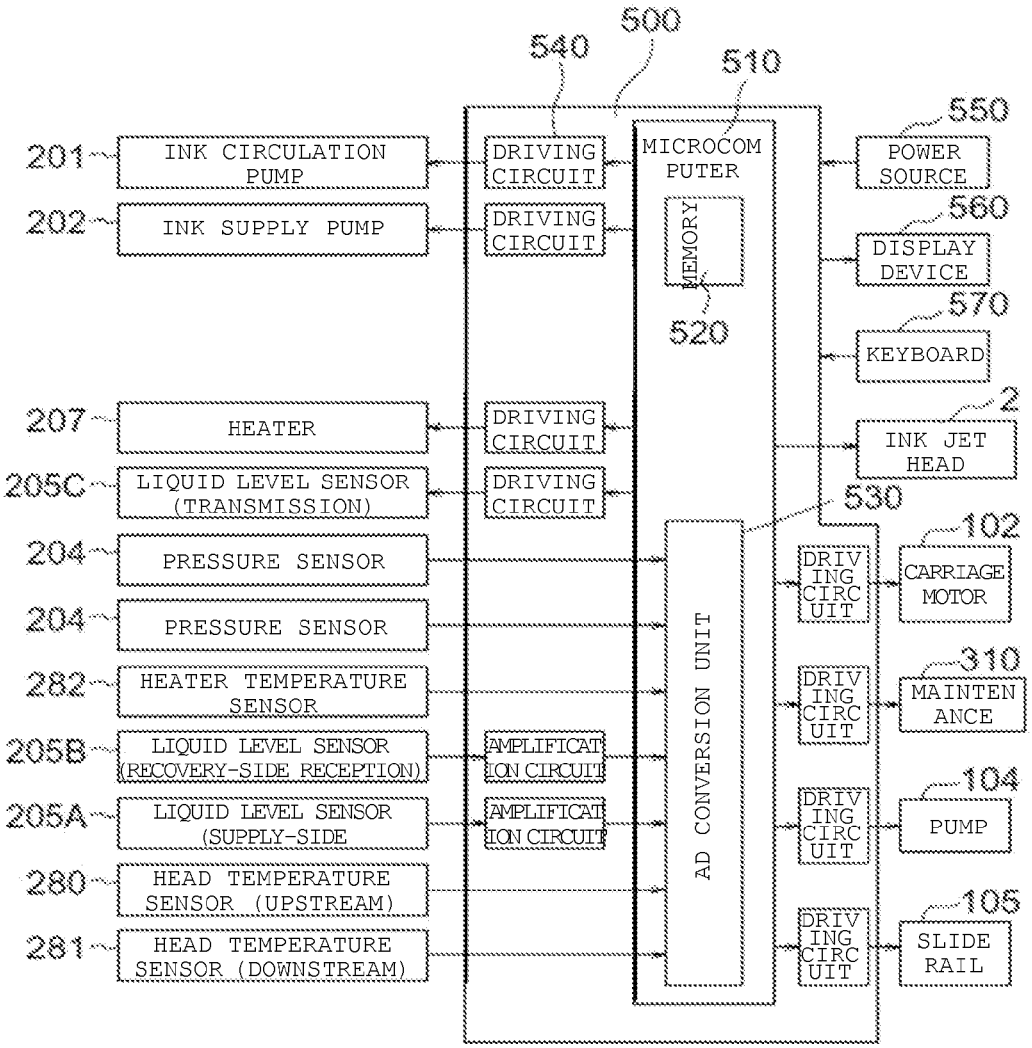
FIG. 12 is a block diagram of a controller that controls the ink jet recording apparatus.

FIG. 12 is a block diagram of the control board 500 which controls the operations of the inkjet recording apparatus 1. A power source 550, a display device 560 that displays an operational state of the ink jet recording apparatus 1, and a keyboard 570 as an input device are connected to the control board 500. The control board 500 includes a microcomputer 510 which controls the operations, a memory 520 which stores programs, and an AD conversion unit 530 which receives output voltages from the pressure sensor 204, and the heater temperature sensors 280, 281, and 282. Moreover, the control board 500 includes a driving circuit 540 to operate the ink jet recording unit 4, the carriage motor 102 that moves the ink jet recording unit 4 relative to the recording medium S, the slide rail 105, the pumps 104, 201, and 202, the heater 207, and the like.

If the inkjet recording apparatus 1 initially performs a printing operation, the ink needs to be supplied to the ink circulation device 3 and the ink jet head 2 from the ink cartridge 106. That is, the ink circulation device 3 and the ink jet head 2 of the ink jet recording unit 4(*a*) are filled with the cyan ink from the ink cartridge 106(*a*). In the same manner, the ink jet recording units 4(*b*) to 4(*e*) are respectively filled with the magenta ink, the yellow ink, the black ink, and the white ink from the ink cartridges 106(*b*) to 106(*e*). When an initial filling operation is instructed through the keyboard 570, the ink jet recording unit 4 is operated in the following order.

The ink jet recording unit 4 is returned to the standby position, and the maintenance unit 310 is lifted to cover the nozzle plate 52. Although the ink is fed to the recovery-side ink chamber 211 of the ink casing 200 from the ink cartridge 106 along with the air in the tube 107 by driving the ink supply pump 202, since the flow resistance in the ink jet head 2 is high, the ink does not flow into the ink jet head 2 and the supply-side ink chamber 210 within a short time. When the ink amount sensor 205B of the recovery-side ink chamber 211 detects that the ink flows into the suction hole 212, the pressure adjusting unit 203 starts to adjust the pressure of the ink in the ink casing 200 and at the same time, the ink circulation pump 201 is driven for a predetermined length of time. The ink is fed to the supply-side ink chamber 210 from the recovery-side ink chamber 211 through the ink circulation pump 201. When the liquid amount detection result of the recovery-side ink chamber 211 and the supply-side ink chamber 210 by the piezoelectric sensors 205A and 205B indicates that the ink reaches the suction hole 212 and the discharge hole 213 of the circulation pump 201, filling the ink is ended. If the amount of ink filled in the recovery-side ink chamber 211 is insufficient, the ink supply pump 202 is driven to feed the ink to the recovery-side ink chamber 211 of the ink casing 200 from the ink cartridge 106. When the ink amount sensor 205B detects that the ink flows into the suction hole 212, the pressure adjusting unit 203 starts to adjust the pressure of the ink in the ink casing 200 and at the same time, the ink circulation pump 201 is driven for a predetermined length of time. The ink is fed to the supply-side ink chamber 210 from the recovery-side ink chamber 211 through the ink circulation pump 201. When the liquid amount detection result of the recovery-side ink chamber 211 and the supply-side ink chamber 210 by the piezoelectric sensors 205A and 205B indicates that the ink reaches the suction hole 212 and the discharge hole 213 of the circulation pump 201, filling the ink is ended. By repeating this operation, the appropriate amount of ink in the recovery-side ink chamber 211 and the supply-side ink chamber 210 is filled, and the initial filling operation is completed. In addition, since the pressure adjusting unit 203 is operated and the ink casing 200 is in a sealed state, even when power from the power supply is cut off, the pressure of the ink at the meniscus 290 of the nozzle 51 is maintained at a negative pressure and thus the ink is not discharged.

The pressure sensor 204 outputs the pressure as a voltage signal. When the pressure sensor 204 is used for a long period of time or environmental (temperature) conditions are changed, the output voltage signal may not indicate a correct pressure. Here, an output voltage value obtained in the atmospheric pressure is saved, and a pressure (gauge pressure) is obtained from the difference between the output voltage value in the atmospheric pressure and the output voltage value during the pressure detection, in order to accurately detect the pressure. When a timing at which the output voltage in the atmospheric pressure is saved, the pressure adjusting unit 203 is connected to the atmosphere. The pressure of the ink in the recovery-side ink chamber 211 becomes the atmospheric pressure, and thus the output voltage value at this time is stored in the memory of the controller. When the pressure of the ink in the ink casing 200 becomes the atmospheric pressure, the meniscus of the nozzle 51 of the ink jet head 2 has a positive pressure and there is a possibility that the ink may be discharged from the nozzle 51. However, since an operation performed in the atmospheric pressure is ended within a short time, when the recovery-side ink chamber 211 is adjusted to have a predetermined pressure after the output voltage value in the atmospheric pressure is saved, the ink is not discharged from the nozzle 51. A timing at which the output voltage value in the atmospheric pressure is saved in the memory is the time when the apparatus is powered on.

As another timing at which the output voltage value in the atmospheric pressure is saved in the memory, the output voltage value may be obtained every predetermined time set by a timer included in the apparatus. If the output voltage value is saved in the memory every predetermined time, when the timing reaches while the ink jet head recording unit 4 performs printing, the printing operation is stopped. In order not to stop the printing operation, the timing at which the output voltage value in the atmospheric pressure is saved is delayed even when a certain time elapses in the timer, and after the printing operation, the output voltage value is saved in the memory.

The printing operation will be described. When the printing operation is instructed through the keyboard 570 or a computer, the maintenance unit 310 is separated from the nozzle plate 52. The pressure adjusting unit 203 adjusts the pressure of the ink in the recovery-side ink chamber 211. The ink circulation pump 201 is driven and the ink is circulated from the recovery-side ink chamber 211 through the ink circulation pump 201, the supply-side ink chamber 210, and the ink jet head 2, and back to the recovery-side ink chamber 211. When the heights of the ink liquid levels (a) and (b) detected by the ink amount sensors 205A and 205B of the supply-side ink chamber 210 and the recovery-side ink chamber 211 are not desired ink liquid heights, the ink supply pump 202 is driven to supply the ink to the recovery-side ink chamber 211 from the ink cartridge 106 until the desired ink liquid heights are reached. The heater 207 attached to the ink casing 200 is conducted to generate heat until the ink reaches a desired temperature. When the desired temperature is reached, the conduction of the heater is controlled so that the ink temperature is within in a certain range.

Next, the ink jet head 2 discharges the ink to the recording medium S according to image data for printing in synchronization with the scanning operation of the carriage 100. By allowing the recording medium S to move a predetermined distance along the slide rail 105 and repeating an operation of discharging the ink in synchronization with the scanning operation of the carriage 100, an image is formed on the recording medium S. When the ink is discharged from the ink jet head 2, the amount of the ink in the ink casing 200 is temporarily reduced, and the pressure of the ink in the recovery-side ink chamber 211 is reduced. When the pressure sensor 204 detects the reduction in the pressure of the ink in the recovery-side ink chamber 211, the pressure adjusting unit 203 performs the pressure adjusting operation to supply ink corresponding to the amount of ink discharged by driving the ink supply pump 202 to the recovery-side ink chamber 211.

Here, since the volume of the ink droplet discharged from the ink jet head 2 is constant and the number of discharged ink droplets may be calculated from the image data, the amount of ink being used is estimated from the multiplication thereof. Therefore, the amount of ink in the ink casing 200 during the printing operation is instantly returned to a predetermined amount.

If the ink is not present in the ink cartridge 106, the ink liquid level of the recovery side ink chamber 211 does not reach a desired height even when the ink supply pump 202 is driven for a predetermined length of time. If the ink liquid level of the recovery-side ink chamber 211 does not reach the desired height, displaying the emptiness of the ink cartridge 106 is executed by the display device 560.

As described above, by using the piezoelectric pump which is small and thin as the ink circulation pump 201 and the ink supply pump 202, the size of the ink circulation unit 3 may be reduced. In addition, since the ink circulation unit 3 is disposed above the ink jet head 2, a distance in the disposition direction of the ink jet head 2 and the ink circulation unit 3 in which the scanning operation is performed on the recording medium S may be shortened. By shortening the distance in the disposition direction, the size of the serial type ink jet recording apparatus 1 may be reduced. Furthermore, since the distance in the disposition direction is shortened, the scanning direction of the carriage 100 may be shortened, resulting in an increase in the printing speed.

By disposing the recovery-side ink chamber and the supply-side ink chamber in a direction substantially perpendicular to the scanning direction of the carriage, vibrations in the ink liquid levels due to the acceleration and deceleration during the scanning operation of the carriage equally occur in the two ink chambers, and thus the meniscus formed by the ink flowing between the two chambers is not affected and thus ink discharge from the nozzle is stabilized.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet apparatus comprising:

an inkjet head having nozzles configured to discharge ink towards a medium and having an ink supply port into which the ink flows and an ink discharge port from which the ink that is not ejected from the nozzle is discharged;

an ink housing having a first tank configured to store ink that is to be supplied to the inkjet head through the ink supply port and a second tank configured to store ink conveyed from the inkjet head through the ink discharge port; and a piezoelectric pump integral with the ink housing and configured to convey ink from the second tank to the first tank, the piezoelectric pump including, a pump housing including an inlet connected to the second tank, a first chamber connected to the inlet, a second chamber having a wall on which piezoelectric material is attached and connected to the first chamber, a third chamber connected to the second chamber, and an outlet connected to the third chamber and the first tank, a first valve member disposed within the first chamber and being movable so that the ink in the inlet flows into the first chamber when a volume of the second chamber is increased, and the ink in the inlet is prevented from flowing into the first chamber when the volume of the second chamber is decreased, and a second valve member disposed within the third chamber and being movable so that the ink in the second chamber flows into the third chamber when the volume of the second chamber is decreased, and the ink in the second chamber is prevented from flowing into the third chamber when the volume of the second chamber is increased.

2. The inkjet apparatus according to claim 1, wherein the wall is configured to deform outwardly to increase the volume of the second chamber, and deform inwardly to decrease the volume of the second chamber.

3. The inkjet apparatus according to claim 2, wherein an electric voltage having a first bias is applied to the piezoelectric material to deform the wall to increase the volume of the second chamber, and an electric voltage having a second bias is applied to the piezoelectric material to deform the wall to decrease the volume of the second chamber.

4. The inkjet apparatus according to claim 1, wherein at least one of the first and second valve members has a plate shape.

5. The inkjet apparatus according to claim 4, wherein said at least one of the first and second valve members has a square shape.

6. The inkjet apparatus according to claim 5, wherein said at least one of the first and second valve members is formed of resin or metal.

7. The inkjet apparatus according to claim 1, wherein the inlet and the outlet extend horizontally, and the inlet is located horizontally with respect to the outlet.

8. The inkjet apparatus according to claim 1, wherein the inkjet head is configured to move in a direction along the surface of the medium, and the inlet and the outlet are arranged along the direction.

9. The inkjet apparatus according to claim 1, wherein the ink housing is integrated with the inkjet head and placed higher than the inkjet head in a gravitational direction.

10. The inkjet apparatus according to claim 1, wherein the inkjet head has a pressure chamber fluidly communicating with the nozzle wherein a part of the ink is ejected from the nozzle and the ink that is not ejected from the nozzle is discharged from the discharge port.

11. An inkjet apparatus comprising:

an inkjet head having nozzles configured to discharge ink towards a medium and having an ink supply port into which the ink flows and an ink discharge port from which the ink that is not ejected from the nozzle is discharged;

an ink circulating unit configured to convey ink to the inkjet head through the ink supply port and recover ink from the inkjet head through the ink discharge port; and a piezoelectric pump integral with the ink circulating unit and configured to supply ink into the ink circulating unit from an ink tank, the piezoelectric pump including, a housing including an inlet connected to the ink tank, a first chamber connected to the inlet, a second chamber having a wall on which piezoelectric material is attached and connected to the first chamber, a third chamber connected to the second chamber, and an outlet connected to the third chamber and the ink circulating unit, a first valve member disposed within the first chamber and being movable so that the ink in the inlet flows into the first chamber when a volume of the second chamber is increased, and the ink in the inlet is prevented from flowing into the first chamber when the volume of the second chamber is decreased, and a second valve member disposed entirely within the third chamber and being movable so that the ink in the second chamber flows into the third chamber when the volume of the second chamber is decreased, and the ink in the second chamber is prevented from flowing into the third chamber when the volume of the second chamber is increased.

12. The inkjet apparatus according to claim 11, wherein the wall is configured to deform outwardly to increase a volume of the second chamber, and deform inwardly to decrease the volume of the second chamber.

13. The inkjet apparatus according to claim 11, wherein at least one of the first and second valve members has a plate shape.

14. The inkjet apparatus according to claim 11, wherein the inlet and the outlet extend horizontally, and the inlet is located vertically with respect to the outlet.

15. The inkjet apparatus according to claim 11, wherein the ink circulating unit is integrated with the inkjet head and placed higher than the inkjet head in a gravitational direction.

16. The inkjet apparatus according to claim 11, wherein the inkjet head has a pressure chamber fluidly communicating with the nozzle wherein a part of the ink is ejected from the nozzle and the ink that is not ejected from the nozzle is discharged from the discharge port.

* * * * *